US007405711B2

(12) United States Patent
Ikeda

(10) Patent No.: US 7,405,711 B2
(45) Date of Patent: Jul. 29, 2008

(54) FIXED-PIXEL DISPLAY DEVICE AND COLD CATHODE FIELD ELECTRON EMISSION DISPLAY DEVICE

(75) Inventor: Hiroyuki Ikeda, Gifu (JP)

(73) Assignee: Sony Corporation (JP)

( * ) Notice: Subject to any disclaimer, the term of this patent is extended or adjusted under 35 U.S.C. 154(b) by 381 days.

(21) Appl. No.: 10/567,923

(22) PCT Filed: Aug. 13, 2004

(86) PCT No.: PCT/JP2004/011953

§ 371 (c)(1),
(2), (4) Date: Feb. 10, 2006

(87) PCT Pub. No.: WO2005/022506

PCT Pub. Date: Mar. 10, 2005

(65) Prior Publication Data

US 2006/0262046 A1 Nov. 23, 2006

(30) Foreign Application Priority Data

Aug. 29, 2003 (JP) ..... 2003-305706

(51) Int. Cl.
*G09G 3/22* (2006.01)

(52) U.S. Cl. ..... 345/75.2; 345/74.1; 345/76; 345/87

(58) Field of Classification Search ..... 345/36–39, 345/45–48, 55, 60, 74.1, 75.1, 75.2, 76–77, 345/87–92, 204, 214; 313/305, 310; 315/169.3, 315/169.4

See application file for complete search history.

(56) References Cited

U.S. PATENT DOCUMENTS 5,578,906 A 11/1996 Smith (Continued)

FOREIGN PATENT DOCUMENTS

JP 08-273560 A 10/1996

(Continued)

OTHER PUBLICATIONS

PCT International Search Report for PCT/JP2004/011953 mailed on Nov. 2, 2004.

(Continued)

*Primary Examiner*—Richard Hjerpe
*Assistant Examiner*—Mansour M Said
(74) *Attorney, Agent, or Firm*—Rader Fishman & Grauer PLLC; Ronald P. Kananen

(57) ABSTRACT

A fixed pixel display device has a construction such that the leading-edge and trailing-edge waveforms of a voltage to be applied to a data electrode can be made steep. The fixed pixel display device is provided with scanning electrodes, data electrodes connected to actuation drivers (50), and light-emitting regions. Each of the actuation drivers (50), includes a switching circuit, an output circuit (51), and a subtraction circuit (52). The switching circuit is equipped with a first switching circuit (53), a second switching circuit (54), and a comparator (55). When a difference ($D_{m,n}$-$D_{m-1,n}$) between values of data for controlling states of light emission at light-emitting regions, composed by the scanning electrodes in $m^{th}$ and $(m-1)^{th}$ rows, is not smaller than a first reference value [not greater than a second reference value], the first switching circuit (53) [the second switching circuit (54)] is maintained in an ON state to apply a first voltage $V_1$ [a second voltage $V_2$] to the data electrode in an $n^{th}$ column. When the difference is smaller than the first reference value and is greater than the second reference value, the first and second switching circuits, (53) and (54), are maintained in OFF states, respectively.

9 Claims, 14 Drawing Sheets

U.S. PATENT DOCUMENTS

| | | | | |
|---|---|---|---|---|
| 5,986,624 | A * | 11/1999 | Ando et al. | 345/74.1 |
| 6,340,962 | B1 | 1/2002 | Konishi et al. | |
| 6,621,475 | B1 * | 9/2003 | Yamaguchi et al. | 345/74.1 |
| 2001/0043172 | A1 * | 11/2001 | McGrath et al. | 345/75.2 |
| 2004/0189553 | A1 * | 9/2004 | Kabuto et al. | 345/75.2 |

FOREIGN PATENT DOCUMENTS

| | | | |
|---|---|---|---|
| JP | 08-287821 | A | 11/1996 |
| JP | 08-292744 | A | 11/1996 |
| JP | 11-084342 | A | 3/1999 |
| JP | 11-296131 | | 10/1999 |
| JP | 2000-182547 | A | 6/2000 |

OTHER PUBLICATIONS

English Translation of International Preliminary Examination Report for PCT/JP2004/011953 mailed May 18, 2006.

* cited by examiner

[STEP – A2]

[STEP – A3]

[STEP – A4]

[STEP – A5]

FIXED-PIXEL DISPLAY DEVICE AND COLD CATHODE FIELD ELECTRON EMISSION DISPLAY DEVICE

TECHNICAL FIELD

This invention relates to a fixed pixel display device and also to a cold cathode field electron emission display device.

BACKGROUND ART

As fixed pixel display devices, each having a structure that a multiple number (M) of stripe-shaped scanning electrodes extending in a first direction and another multiple number N of stripe-shaped data electrodes extending in a second direction different from the first direction (for example, intersecting at right angles with), are provided and light-emitting regions, formed of overlap regions of the scanning electrodes and the data electrodes, are arrayed in a two-dimensional matrix form of M rows×N columns, known examples include cold cathode field electron emission display devices, liquid crystal displays, organic electroluminescence displays, and inorganic electroluminescence displays (see, for example, Japanese Patent Laid-open No. Hei 11-296131). In these fixed pixel display devices, the line-sequential drive method is often adopted. The term "line-sequential drive method" means a method that in scanning electrodes and data electrodes intersecting with each other in a matrix form, scanning signals are inputted to desired scanning electrodes to select and scan them such that, based on video signals (also called "chrominance signals") inputted to the data electrodes, an image is displayed to create a single frame of picture.

To each data electrode, an output circuit 100 for the data electrode, the circuit diagram of which is shown in FIG. 14, is generally connected. It is to be noted that an equivalent circuit of the data electrode is also depicted in FIG. 14. This output circuit 100 for the data electrode is, for example, a current buffer circuit formed of a CMOS circuit.

In general, a video signal is inputted to an A/D converter 41, an output from the A/D converter 41 is once stored in a line buffer 42 and is then fed to a D/A converter 43, and an analog signal from the D/A converter 43 is fed to the output circuit 100 for the data electrode. On the other hand, scanning electrodes are connected to output circuits for the scanning electrodes, respectively. It is to be noted that neither a scanning electrode nor an output circuit for the scanning electrode is shown in FIG. 14. Upon actuation of the output circuits for the scanning electrodes on the basis of a switching timing pulse (load signal), the scanning electrodes in the $1^{st}$ row to the $M^{th}$ row are energized in a line-sequential manner so that, for example, a fixed voltage is sequentially applied to the scanning electrodes. On the data electrode in an $n^{th}$ column (n=1, 2, . . . , N), on the other hand, a voltage $V_{DATA}$, which is variable by a voltage modulation method, is applied in accordance with a gradation from the output circuit 100 for the data electrode (see FIG. 3B).

The leading-edge and trailing-edge waveforms of a voltage $V_{DATA}$ to be applied to the data electrode from the output circuit 100 for the data electrode, however, hardly become steep, as illustrated under in FIG. 3B, because a capacity component exists in the data electrode, as shown in FIG. 14. Unless the waveform of the voltage $V_{DATA}$ to be applied to the data electrode is steep, the response for the display of an image is reduced, thereby making it difficult to smoothly display the image. In a cold cathode field electron emission display device, large capacitance components generally tend to exist in data electrodes, for example, cathode electrodes, and as a consequence, the leading-edge and trailing-edge waveforms of voltages $V_{DATA}$ to be applied to the data electrodes are still more difficult to become steep.

An object of the present invention is, therefore, to provide a fixed pixel display device and a cold cathode field electron emission display device, each of which has a construction capable of making steep the leading-edge and trailing-edge waveforms of voltages to be applied to electrodes.

DISCLOSURE OF INVENTION

A fixed pixel display device, according to the present invention for achieving the above-described object, is provided with a multiple number M (M≧2) of stripe-shaped scanning electrodes extending in a first direction and another multiple number N(N≧2) of stripe-shaped data electrodes extending in a second direction different from the first direction such that light-emitting regions formed of overlap regions of the scanning electrodes and the data electrodes are arrayed in a two-dimensional matrix form of M rows×N columns, and is characterized in that:

the fixed pixel display device is provided with actuation drivers connected to the respective data electrodes to actuate the data electrodes;

each actuation driver includes a switching circuit, an output circuit, and a subtraction circuit;

the switching circuit is provided with:

(A) a first switching circuit for applying a first voltage $V_1$ to the corresponding data electrode, (B) a second switching circuit for applying a second voltage $V_2$ ($V_2 \neq V_1$) to the corresponding data electrodes, and (C) a comparator for performing on/off control of the first switching circuit and second switching circuit;

a voltage, outputted from the output circuit on a basis of a value $D_{m,n}$ (m: any one of 2, 3, . . . , M; n: 1, 2, . . . , N) of data for controlling states of light emission at a multiple number N of light-emitting regions formed of the scanning electrode in an $m^{th}$ row, is applied for a fixed duration to the data electrode in an $n^{th}$ column; and a value ($D_{m,n}-D_{m-1,n}$), obtained by subtracting at the subtraction circuit a value ($D_{m-1,n}$) of data for controlling states of light emission at respective light-emitting regions, formed of the scanning electrode in an $(m-1)^{th}$ row, from a value ($D_{m,n}$) of data for controlling states of light emission at respective light-emitting regions, formed of the scanning electrode in the $m^{th}$ row, is inputted as an input value in the comparator, and the input value, inputted in the comparator, is compared with a first reference value and a second reference value at the comparator;

(1) when the input value is not smaller than the first reference value, the first switching circuit is maintained in an ON state for a predetermined duration shorter than the fixed duration on a basis of an output from the comparator such that during the predetermined duration, a first voltage $V_1$ is applied to the data electrode in the $n^{th}$ column;

(2) when the input value is not greater than the second reference value, the second switching circuit is maintained in an ON state for a predetermined duration, shorter than the fixed duration on a basis of the output from the comparator, such that during the predetermined duration, a second voltage $V_2$ is applied to the data electrode in the $n^{th}$ column; and (3) when the input value is smaller than the first reference value but is greater than the second reference value, the first switching circuit and the second switching circuit are maintained in OFF-states, respectively.

In the fixed pixel display device, according to the present invention, a voltage, outputted from the output circuit on the basis of a value $D_{1,n}$(n: 1, 2, . . . , N) of data to control the states of light emission at a multiple number N of light-emitting regions, composed by the scanning electrode in the $1^{st}$ row, is applied for the fixed duration to the $n^{th}$ data electrode. In this case, a value ($D_{1,n}-D_{0,n}$), obtained by subtracting at the subtraction circuit a data value "0" (which is to be expressed as "a value $D_{0,n}$ of data") from a value $D_{1,n}$ of data for controlling the states of light emission at the respective light-emitting regions, composed by the scanning electrode in the first row, is inputted as an input value in the comparator, and the input value, inputted in the comparator, is compared with the first reference value and the second reference value at the comparator. Instead of using the value $D_{0,n}$ of data, the value $D_{m,n}$ of immediately preceding data (the value of the last data in a frame preceding by one frame) can also be used.

The cold cathode field electron emission display device, according to a first embodiment of the present invention for achieving the above-described object, includes a cathode panel and an anode panel joined together at peripheral edge portions thereof, and is characterized in that:

the cathode panel is composed of:

(a) a support, (b) a multiple number N(N≧2) of stripe-shaped cathode electrodes formed on the support and extending in a first direction, (c) an insulating layer formed over the support and cathode electrodes, (d) another multiple number M (M≧2) of stripe-shaped gate electrodes formed on the insulating layer and extending in a second direction different from the first direction, and (e) electron-emitting regions located at overlap regions of the cathode electrodes and the gate electrodes;

the anode panel is composed of a substrate and phosphor regions and an anode electrode formed on the substrate and arranged corresponding to the electron-emitting regions;

the electron-emitting regions are composed of electron-emitting portions located in bottom parts of holes arranged in the gate electrodes and insulating layer;

the cold cathode field electron emission display device is further provided with:

(f) actuation drivers connected to the respective cathode electrodes to actuate the cathode electrodes;

each actuation driver comprises a switching circuit, an output circuit, and a subtraction circuit;

the switching circuit is provided with:

(A) a first switching circuit for applying a first voltage $V_1$ to the corresponding cathode electrode, (B) a second switching circuit for applying a second voltage $V_2$ ($V_2>V_1$) to the corresponding cathode electrode, and (C) a comparator for performing on/off control of the first switching circuit and second switching circuit;

a voltage, outputted from the output circuit on a basis of a value $D_{m,n}$(m: any one of 2, 3, . . . , M; n: 1, 2 . . . , N) of data for controlling states of electron emission at a multiple number N of electron-emitting regions formed of an $m^{th}$ gate electrode, is applied for a fixed duration to an $n^{th}$ cathode electrode; and a value ($D_{m,n}-D_{m-1,n}$), obtained by subtracting at the subtraction circuit a value ($D_{m-1,n}$) of data for controlling states of light emission at the respective light-emitting regions formed of an $(m-1)^{th}$ gate electrode from a value ($D_{m,n}$) of data for controlling states of light emission at the respective light-emitting regions composed by the $m^{th}$ gate electrode, is inputted as an input value in the comparator, and the input value, inputted in the comparator, is compared with a first reference value and a second reference value at the comparator;

(1) when the input value is not smaller than the first reference value, the first switching circuit is maintained in an ON state for a predetermined duration shorter than the fixed duration on a basis of an output from the comparator such that during the predetermined duration, a first voltage $V_1$ is applied to the $n^{th}$ cathode electrode;

(2) when the input value is not greater than the second reference value, the second switching circuit is maintained in an ON state for a predetermined duration, shorter than the fixed duration on a basis of the output from the comparator, such that during the predetermined duration, a second voltage $V_2$ is applied to the $n^{th}$ cathode electrode; and (3) when the input value is smaller than the first reference value, but is greater than the second reference value, the first switching circuit and the second switching circuit are maintained in OFF-states, respectively.

In the cold cathode field electron emission display device, according to the first embodiment of the present invention, a voltage, outputted from the output circuit, on the basis of a value $D_{1,n}$(n: 1, 2, . . . , N) of data to control the states of electron emission at a multiple number N of electron-emitting regions composed by the $1^{st}$ gate electrode, is applied for the fixed duration to the $n^{th}$ cathode electrode. In this case, a value ($D_{1,n}-D_{0,n}$) obtained by subtracting at the subtraction circuit a data value "0" (which is to be expressed as "a value $D_{0,n}$ of data") from a value V of data for controlling the states of light emission at the multiple number N of light-emitting regions composed by the $1^{st}$ gate electrode, is inputted as an input value in the comparator, and the input value, inputted in the comparator, is compared with the first reference value and the second reference value at the comparator. Instead of using the value $D_{0,n}$ of data, the value $D_{M,n}$ of immediately preceding data (the value of the last data in a frame preceding by one frame) can be also used.

A cold cathode field electron emission display device, according to a second embodiment of the present invention for achieving the above-described object, includes a cathode panel and an anode panel, joined together at peripheral edge portions thereof, and is characterized in that:

the cathode panel is composed of:

(a) a support, (b) a multiple number M (M≧2) of stripe-shaped cathode electrodes formed on the support and extending in a first direction, (c) an insulating layer formed over the support and cathode electrodes, (d) another multiple number N(N≧2) of stripe-shaped gate electrodes formed on the insulating layer and extending in a second direction different from the first direction, and (e) electron-emitting regions located at overlap regions of the cathode electrodes and the gate electrodes;

the anode panel is composed of a substrate and phosphor regions and an anode electrode formed on the substrate and arranged corresponding to the electron-emitting regions;

the electron-emitting regions are composed of electron-emitting portions located in bottom parts of holes arranged in the gate electrodes and insulating layer;

the cold cathode field electron emission display device is further provided with:

(f) actuation drivers connected to the respective gate electrodes to actuate the gate electrodes;

each actuation driver includes a switching circuit, an output circuit, and a subtraction circuit;

the switching circuit is provided with:

(A) a first switching circuit for applying a first voltage $V_1$ to the corresponding gate electrode, (B) a second switching circuit for applying a second voltage $V_2$ ($V_2>V_1$) to the corresponding gate electrode, and (C) a comparator for performing on/off control of the first switching circuit and second switching circuit;

a voltage, outputted from the output circuit on a basis of a value $D_{m,n}$(m: any one of 2, 3, . . . , M; n: 1, 2, . . . , N) of data for controlling states of electron emission at a multiple number N of electron-emitting regions formed of an $m^{th}$ cathode electrode, is applied for a fixed duration to an $n^{th}$ gate electrode; and a value ($D_{m,n}-D_{m-1,n}$), obtained by subtracting at the subtraction circuit a value $D_{m-1,n}$ of data for controlling states of light emission at the respective light-emitting regions formed of an $(m-1)^{th}$ cathode electrode from a value $D_{m,n}$ of data for controlling states of light emission at the respective light-emitting regions composed by the $m^{th}$ cathode electrode, is inputted as an input value in the comparator, and the input value, inputted in the comparator, is compared with a first reference value and a second reference value at the comparator;

(1) when the input value is not smaller than the first reference value, the first switching circuit is maintained in an ON state for a predetermined duration, shorter than the fixed duration on a basis of an output from the comparator such that during the predetermined duration, a first voltage $V_1$ is applied to the $n^{th}$ gate electrode;

(2) when the input value is not greater than the second reference value, the second switching circuit is maintained in an ON state for a predetermined duration, shorter than the fixed duration on a basis of the output from the comparator such that during the predetermined duration, a second voltage $V_2$ is applied to the $n^{th}$ gate electrode; and (3) when the input value is smaller than the first reference value but is greater than the second reference value, the first switching circuit and the second switching circuit are maintained in OFF-states, respectively.

In the cold cathode field electron emission display device, according to the second embodiment of the present invention, a voltage, outputted from the output circuit on the basis of a value $D_{1,n}$(n: 1, 2, . . . , N) of data to control the states of electron emission at a multiple number N of electron-emitting regions composed by the $1^{st}$ cathode electrode, is applied for the fixed duration to the $n^{th}$ gate electrode. In this case, a value ($D_{1,n}-D_{0,n}$), obtained by subtracting at the subtraction circuit a data value "0" (which is to be expressed as "a value $D_{0,n}$ of data") from a value $D_{1,n}$ of data for controlling the states of light emission at the multiple number N of light-emitting regions composed by the $1^{st}$ cathode electrode, is inputted as an input value in the comparator, and the input value, inputted in the comparator, is compared with the first reference value and the second reference value at the comparator. Instead of using the value $D_{0,n}$, of data, the value $D_{M,n}$ of immediately preceding data (the value of the last data in a frame preceding by one frame) can be also used.

In the fixed pixel display device, according to the present invention, it is preferred that, when a difference between a voltage to be applied to the scanning electrode and a voltage to be applied to the data electrode is assumed to be $\Delta V$, the first voltage $V_1$ is a voltage to be applied to the data electrode to obtain a maximum value of $\Delta V$, and the second voltage $V_2$ is a voltage to be applied to the data electrode to obtain a minimum value of $\Delta V$. In other words, $V_1<V_2$ is preferred when a voltage to be applied to the scanning electrode is greater than a voltage to be applied to the data electrode, while $V_1>V_2$ is preferred when (a voltage to be applied to the scanning electrode)<(a voltage to be applied to the data electrode). In the cold cathode field electron emission display device, according to the first embodiment of the present invention, it is preferred that, when a difference between a voltage to be applied to the gate electrode and a voltage to be applied to the cathode electrode is assumed to be $\Delta V_{GC}$, the first voltage $V_1$ is a voltage (for example, 0 volt) to be applied to the cathode electrode to obtain a maximum value of $\Delta V_{GC}$, and the second voltage $V_2$ is a voltage (>0 volt) to be applied to the cathode electrode to obtain a minimum value of $\Delta V_{GC}$. In the cold cathode field electron emission display device, according to the second embodiment of the present invention, it is preferred that, when a difference between a voltage to be applied to the gate electrode and a voltage to be applied to the cathode electrode is assumed to be $\Delta V_{GC}$, the first voltage $V_1$ is a voltage to be applied to the gate electrode to obtain a maximum value of $\Delta V_{GC}$, and the second voltage $V_2$ is a voltage to be applied to the gate electrode to obtain a minimum value of $\Delta V_{GC}$. It is, however, to be noted that the first voltage $V_1$ and the second voltage $V_2$ shall not be limited to these values.

In the fixed pixel display device, according to the present invention, or the cold cathode field electron emission display devices, according to the first embodiment or the second embodiment of the present invention, including these embodiments, the output circuit can be a current buffer circuit which may comprise, for example, a CMOS circuit or a bipolar circuit. It is to be noted that a current buffer circuit means a circuit having a voltage gain of 1 and a current gain greater than 1. Specifically, a current buffer circuit means a circuit that an input voltage to the current buffer circuit and an output voltage from the current buffer circuit are equal to each other and an output current from the current buffer circuit is greater than an input current to the current buffer circuit. It is also to be noted that the output circuit may be constructed of a voltage amplification circuit, which is a circuit having a voltage gain greater than 1.

As the fixed pixel display device, according to the present invention, a fixed pixel display device of the type that the luminance is controlled by a voltage applied to electrodes, that is, a fixed pixel display device a gradation control system of which is a voltage modulation system can be mentioned. Specific examples can include cold cathode field electron emission display devices, liquid crystal displays, organic electroluminescence displays, and inorganic electroluminescence displays.

In the fixed pixel display device, according to the present invention, and the cold cathode field electron emission display devices, according to the first embodiment and second embodiment of the present invention (which may hereinafter be collectively and simply called "the present invention"), the first switching circuit and second switching circuit, which make up the switching circuit, can be switching circuits of any type. For example, switching circuits, each of which comprises NMOS-FET, can be mentioned. The subtraction circuit and the comparator, on the other hand, can be composed of a known subtraction circuit and comparator, respectively.

The fixed pixel display device, according to the present invention, and the cold cathode field electron emission display devices, according to the first embodiment and second embodiment of the present invention, may preferably be driven by the line-sequential drive method. The term "line-sequential drive method" means a method that, of the groups of electrodes intersecting with each other in a matrix form, the gate electrodes and cathode electrodes are used, for example, as scanning electrodes and data electrodes, respectively. The gate electrodes are selected and scanned based on scanning signals and based on signals (called "video signals", "data signals" or "chrominance signals") from the cathode electrodes, an image is displayed to create a frame of picture. Or, the cathode electrodes and gate electrodes are used, for example, as scanning electrodes and data electrodes, respectively. The cathode electrodes are selected and scanned based on scanning signals and based on signals (called "video signals", "data signals" or "chrominance signals") from the gate electrodes, an image is displayed to create a frame of picture.

In the present invention, the term "fixed duration ($T_1$)" specifically means one scanning duration (time). In other words, the M-fold of the fixed duration ($T_1$) is one frame duration. Further, it is desired that the predetermined duration ($T_2$) and the fixed duration ($T_1$) meet the relationship of $T_2<T_1$, preferably $0.1T_1 \leqq T_2 \leqq -0.8T_1$, more preferably $0.1T_1 \leqq T_2 < 0.4T_1$. It is also desired that the predetermined duration ($T_2$) and the fixed duration ($T_1$) commence at the same time.

In the fixed pixel display device, according to the present invention, $V_1<V_2$ when a voltage to be applied to the scanning electrode is greater than a voltage to be applied to the data electrode. Supposing that the first reference value is set at a value corresponding to a voltage $\alpha(V_2-V_1)$ and the second reference value is set at a value corresponding to a voltage $\beta(V_1-V_2)$, these voltages, $\alpha$ and $\beta$, therefore, preferably satisfy $0.125 \leqq \alpha \leqq 0.75$ and $0.125 \leqq \beta \leqq 0.75$. It is to be noted that depending on the circuit construction, the value corresponding to the voltage $\alpha$ may be a digital value or an analog value and that this will apply equally to the subsequent description on the first reference value. It is also to be noted that depending on the circuit construction, the value corresponding to the voltage $\beta$ may be a digital value or an analog value and that this will apply equally to the subsequent description on the second reference value. When a voltage to be applied to the scanning electrode is less than a voltage to be applied to the data electrode, on the other hand, $V_1>V_2$. Supposing that the first reference value is set at a value corresponding to a voltage $\alpha(V_1-V_2)$ and the second reference value is set at a value corresponding to a voltage $\beta(V_2-V_1)$, these voltages, $\alpha$ and $\beta$, therefore, preferably satisfy $0.125 \leqq \alpha \leqq 0.75$ and $0.125 \leqq \beta 0.75$.

In the fixed pixel display device, according to the first embodiment of the present invention, $V_2>V_1$. Supposing that the first reference value is set at a value corresponding to a voltage $\alpha(V_2-V_1)$ and the second reference value is set at a value corresponding to a voltage $\beta(V_1-V_2)$, these voltages, $\alpha$ and $\beta$, therefore, preferably satisfy $0.125 \leqq \alpha \leqq -0.75$ and $0.125 \leqq \beta \leqq 0.75$.

In the fixed pixel display device, according to the second embodiment of the present invention, $V_2<V_1$. Supposing that the first reference value is set at a value corresponding to a voltage $\alpha(V_1-V_2)$ and the second reference value is set at a value corresponding to a voltage $\beta(V_2-V_1)$, these voltages, $\alpha$ and $\beta$, therefore, preferably satisfy $0.125 \leqq \alpha \leqq 0.75$ and $0.125 \leqq \beta \leqq 0.75$.

In the present invention, the expression "a value $D_{m,n}$ of data (gradation control data) for controlling states of light emission at a multiple number N of light-emitting regions formed of the scanning electrode in an $m^{th}$ row" means data that specifies a voltage to be applied to the data electrode in the $n^{th}$ row; the expression "a value $D_{m,n}$ of data (gradation control data) for controlling states of electron emission at a multiple number N of electron-emitting regions formed of an $m^{th}$ gate electrode" means data that specifies a voltage to be applied to the $n^{th}$ cathode electrode; and the expression "a value $D_{m,n}$ of data (gradation control data) for controlling states of electron emission at a multiple number N of electron-emitting regions formed of an $m^{th}$ cathode electrode" means data that specifies a voltage to be applied to the $n^{th}$ gate electrode. It is to be noted that the above description embraces therein the case of m=1.

Further, it is equivalent to replace "when the input value is not smaller than the first reference value" by "when the input value exceeds the first reference value". It is also equivalent to replace "when the input value is not greater than the second reference value" by "when the input value is smaller than the second reference value". And, it is also equivalent to replace "the input value is smaller than the first reference value and is greater than the second reference value" by "the input value is not greater than the first reference value and is not smaller than the second reference value".

In the present invention, it is preferred, from the viewpoint of structural simplification of the fixed pixel display device and cold cathode field electron emission display devices, that the first direction and the second direction lie at right angles to each other. For example, a projection image of the scanning electrodes or cathode electrodes and a projection image of the data electrodes or gate electrodes lie at right angles to each other.

As the combination of M and N values in the present invention, some image display resolutions can be specifically exemplified such as (1920, 1080), (1920, 1035), (1024, 768), (800, 600), (640, 480), (720, 480), (1280, 960), and (1280, 1024), although the combination is not limited to these values.

In the cold cathode field electron emission display devices, according to the first embodiment and second embodiment of the present invention (which may hereinafter be collectively and simply called "the cold cathode field electron emission display devices, according to the present invention"), a strong electrical field, produced by voltages applied to the cathode electrode and gate electrode, is applied to the electron-emitting portion, and, as a result, electrons are emitted from the electron-emitting portion by the quantum tunnel effect. These electrons are then attracted toward the anode electrode arranged on the anode panel and impinge on the phosphor region. In other words, an emitted electron current flows from the anode electrode to the cathode electrode. As a result of the impingement of the electrons on the phosphor region, the phosphor region emits light so that the electrons can be recognized as an image. By one or more electron-emitting portions arranged or located in a region where a projection image of the cathode electrode and a projection image of the gate electrode overlap with each other (overlap region), an electron emitting region is constituted.

In the cold cathode field electron emission display device, according to the present invention, the cathode electrodes are connected to a cathode electrode control circuit, the gate electrodes are connected to a gate electrode control circuit, and the anode electrode is connected to an anode electrode control circuit. The output voltage VA of the anode electrode control circuit is generally constant and, for example, can be set at 5 kilovolts to 10 kilovolts. Concerning the voltage $V_C$ to be applied to the cathode electrodes and the voltage $V_G$ to be applied to the gate electrodes, on the other hand, there are the following methods because the gradation control method is a voltage modulation method:

(1) The voltage $V_C$ to be applied to the cathode electrodes is kept constant while the voltage $V_G$ to be applied to the gate electrodes is changed;

(2) The voltage $V_C$ to be applied to the cathode electrodes is changed while the voltage $V_G$ to be applied to the gate electrodes is kept constant; and (3) The voltage $V_C$ to be applied to the cathode electrodes is changed, and the voltage $V_G$ to be applied to the gate electrodes is also changed.

In the cold cathode field electron emission display device, according to the present invention, it is only necessary for the support, which constitutes the cathode panel, and the substrate, which constitutes the anode panel, that at least their surfaces are formed of insulating members. Various glass substrates, such as alkali-free glass substrates, low-alkali glass substrates or quartz glass substrates, various glass substrates with insulating films formed on the surfaces thereof, quartz substrates, or semiconductor substrates with insulating films formed on the surfaces thereof, can be mentioned. In order to reduce production costs, however, it is preferred to use glass substrates or glass substrates with insulating films formed on the surfaces thereof. More specific examples of the glass which makes up such glass substrates can include high strain point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$).

Examples of materials, which make up the cathode electrodes, the gate electrodes and focusing electrodes (which will be described subsequently herein) in the cathode panel, which in turn constitutes the cold cathode field electron emission display device, according to the present invention, can include at least one metal selected from the group consisting of tungsten (W), niobium (Nb), tantalum (Ta), titanium (Ti), molybdenum (Mo), chromium (Cr), aluminum (Al), copper (Cu), gold (Au), silver (Ag), nickel (Ni), cobalt (Co), zirconium (Zr), iron (Fe), platinum (Pt) and zinc (Zn); alloys or compounds containing these metal elements (for example, nitrides such as TiN, and silicides such as $WSi_2$, $MoSi_2$, $TiSi_2$ and $TaSi_2$); semiconductors such as silicon (Si); thin carbon films such as diamond; and conductive metal oxides such as ITO (indium-tin oxide), indium oxide and zinc oxide.

As an illustrative process for forming the cathode electrodes, gate electrodes and focusing electrodes, a combination of a deposition process such as electron beam deposition or hot filament deposition, a sputtering process, a CVD process or an ion plating process with an etching process; a screen printing process; a plating process (electroplating or electroless plating); a lift-off process; a laser abrasion process; or a sol-gel process can be mentioned. According to a screen printing process or plating process, the electrodes, gate electrodes and focusing electrodes can be directly formed, for example, in the forms of stripes.

As a constituent material of the insulating layer or an interlayer insulating layer to be described subsequently herein, $SiO_2$-based materials such as $SiO_2$, BPSG, PSG, BSG, AsSG, PbSG, SiN, SiON, SOG (spin-on glass), low-melting glass and glass paste; SiN; and insulating resins such as polyimide can be used either singly or in combination. For the formation of the insulating layer and the interlayer insulating layer to be described subsequently herein, a known process such as CVD process, coating process, sputtering process or screen printing process can be used.

In the cold cathode field electron emission display device, according to the present invention, cold cathode field electron emission devices (hereinafter abbreviated as "the field emission devices") are composed of:

(a) stripe-shaped cathode electrodes formed on a support and extending in a first direction, (b) an insulating layer formed over the support and the cathode electrodes, (c) stripe-shaped gate electrode formed on the insulating layer and extending in a second direction, different from the first direction, (d) holes arranged in the gate electrodes and the insulating layer, and (e) electron-emitting portions located in bottom parts of the holes.

The field emission devices can be provided as field emission devices of any form. Examples can include:

(1) Spindt-type field emission devices with conical electron-emitting portions arranged on a cathode electrode located in bottom parts of holes, (2) Flattened field emission devices with substantially flat electron-emitting portions arranged on a cathode electrode located in bottom parts of holes, (3) Crown-shaped field emission devices with crown-shaped electron-emitting portions arranged on a cathode electrode located in bottom parts of holes such that electrons are emitted from crown-shaped parts of the electron-emitting portions, (4) Planar field emission devices which emit electrons from the surface of a planer cathode electrode, (5) Crater-shaped field emission devices which emit electrons from a number of convexities on a surface of a cathode electrode, said surface carrying concavities and the convexities formed thereon, and (6) Edged field emission devices which emit electrons from edge portions of a cathode electrode.

As field emission devices, devices commonly called "surface conductive field emission devices" are also known in addition to the above-mentioned various types, and such surface conductive field emission devices can also be applied to the cold cathode field electron emission display device. In each surface conductive field emission device, thin films, made of a material such as tin oxide ($SnO_2$), gold (Au), indium oxide ($In_2O_3$)/tin oxide ($SnO_2$), carbon or palladium oxide (PdO) and having extremely small areas, are formed in a matrix form on a substrate made, for example, of glass. Each of these thin films is composed of two thin film pieces, a row-direction wiring line is connected to one of the thin film pieces, and a column-direction wiring line is connected to the other thin film piece. Between the one thin film piece and the other thin film piece, a gap of several nanometers is arranged. At the thin film, selected by the row-direction wiring line and the column-direction wiring line, electrons are emitted from the thin film through the gap.

As a material that makes up electron-emitting portions in Spindt-type field emission devices, at least one material selected from the group consisting of tungsten, tungsten alloys, molybdenum, molybdenum alloys, titanium, titanium alloys, niobium, niobium alloys, tantalum, tantalum alloys, chromium, chromium alloys, and impurity-containing silicons (polysilicons and amorphous silicons) can be mentioned. The electron-emitting portions in Spindt-type field emission devices can be formed, for example, by vacuum deposition, sputtering or CVD.

As a material that makes up electron-emitting portions in flattened field emission devices, it is preferred to constitute them with a material having a smaller work function Φ than a material that makes up the cathode electrodes. As to which material should be selected, a determination can be made based on the work function of the material making up the cathode electrodes, the difference in potential between the gate electrodes and the cathode electrodes, the magnitude of an emitted electron current density to be required, and the like. Examples of a representative material, which makes up the cathode electrodes in the field emission devices, can include tungsten (Φ=4.55 eV), niobium (Φ=4.02 to 4.87 eV), molybdenum (Φ=4.53 to 4.95 eV), aluminum (Φ=4.28 eV), copper (Φ=4.6 eV), tantalum (Φ=4.3 eV), chromium (Φ=4.5 eV), and silicon (Φ=4.9 eV). It is preferred for the electron-emitting portions to have a smaller work function Φ than these materials, and preferably, its value can be 3 eV or smaller in general. Examples of such a material can include carbon (Φ<1 eV), cesium (Φ=2.14 eV), $LaB_6$ (Φ=2.66 to 2.76 eV), BaO (Φ=1.6 to 2.7 eV), SrO (Φ=1.25 to 1.6 eV), $Y_2O_3$ (Φ=2.0 eV), CaO (Φ=1.6 to 1.86 eV), BaS (Φ=2.05 eV), TiN (Φ=2.92 eV), and ZrN (Φ=2.92 eV). It is more preferred to make up the electron-emitting portions with a material the work function Φ of which is 2 eV or smaller. It is to be noted that the material making up the electron-emitting portions is not absolutely required to be equipped with electrical conductivity.

As an alternative, the material that makes up the electron-emitting portions of the flattened field emission devices may be selected as desired from materials the secondary electron gains δ of which become greater than the secondary electron gain δ of the conductive material making up the cathode electrodes. Described specifically, the material that makes up the electron-emitting portions can be selected as desired from metals such as silver (Ag), aluminum (Al), gold (Au), cobalt (Co), copper (Cu), molybdenum (Mo), niobium (Nb), nickel (Ni), platinum (Pt), tantalum (Ta), tungsten (W) and zirconium (Zr); semiconductors such as silicon (Si) and germanium (Ge); inorganic simple substances such as carbon and diamond; and compounds such as aluminum oxide ($Al_2O_3$), barium oxide (BaO), beryllium oxide (Beo), calcium oxide (CaO), magnesium oxide (MgO), tin oxide ($SnO_2$), barium fluoride ($BaF_2$) and calcium fluoride ($CaF_2$) It is to be noted that the material making up the electron-emitting portions is not absolutely required to be equipped with electrical conductivity.

As a particularly preferred material of the electron-emitting portions in the flattened field emission devices, carbon, more specifically diamond, graphite, graphite nanofibers, a carbon nanotube structure, ZnO whiskers, Mgo whiskers, $SnO_2$ whiskers, MnO whiskers, $Y_2O_3$ whiskers, NiO whiskers, ITO whiskers, $In_2O_3$ whiskers, or $Al_2O_3$ whiskers can be mentioned. When the electron-emitting portions are made of such a material, an emitted electron current density required for the cold cathode field electron emission display device can be obtained at a field strength of $5\times10^7$ V/m or lower. Diamond is an electrically resistant material and, therefore, can equalize emitted electron currents to be obtained from the respective electron-emitting portions, thereby making it possible to reduce variations in luminance when such flattened field emission devices are incorporated in the cold cathode field electron emission display device. These materials have extremely high durability against sputtering action by ions of residual gas in the cold cathode field electron emission display device and, therefore, can provide the field emission devices with a longer service life.

As the carbon nanotube structure, carbon nanotobues and/or carbon nanofibers can be mentioned specifically. More specifically, the electron-emitting portions may be formed of carbon nanotubes, carbon nanofibers, or a mixture of carbon nanotubes and carbon nanofibers. Macroscopically, carbon nanotubes and carbon nanofibers can each be in the form of powder or in the form of thin films, and in some instances, a carbon nanotube structure can have a circular conical shape. Carbon nanotubes and carbon nanofibers can be produced and formed by any one of known PVD processes such as arc discharge process and laser abrasion process or by any one of various CVD processes such as plasma CVD, laser CVD, thermal CVD, vapor phase synthesis process and vapor phase growth process.

The flattened field emission devices can be fabricated by, for example, coating a dispersion of a carbon nanotube structure or graphite nanofibers or one of the above-described various kinds of whiskers (hereinafter collectively called "the carbon nanotube structure of the like) in a binder material to desired regions on cathode electrodes and then firing or hardening the binder material. More specifically, by applying, for example, a dispersion of a carbon nanotube structure or the like in an organic binder material such as an epoxy resin or acrylic resin or an inorganic binder material such as water glass to desired regions on cathode electrodes, removing the solvent, and then firing or hardening the binder material. It is to be noted that such a process will be called "the first formation process of a carbon nanotube structure or the like." As a coating process, screen printing can be mentioned as an example.

As an alternative, the flattened field emission devices can also be fabricated by coating a solution of a metal compound, in which a carbon nanotube structure or the like is dispersed, on the cathode electrodes and then firing the metal compound. By this process, the carbon nanotube structure or the like is fixed on the surfaces of the cathode electrodes with a matrix which contains metal atoms constituting the metal compound. It is to be noted that such a process will be called "the second formation process of a carbon nanotube structure or the like". The matrix may preferably be composed of a metal oxide having electrical conductivity, and more specifically, the matrix can be formed of tin oxide, indium oxide, indium oxide/tin, zinc oxide, antimony oxide or antimony oxide-tin. After the firing, each carbon nanotube structure or the like may have been brought into a state that it is partly embedded in the matrix, or each carbon nanotube structure or the like may have been brought into a state that it is entirely embedded in the matrix. The volume resistivity of the matrix may desirably be $1\times10^{-9}\Omega$ to $5\times10^{-6}\Omega$.

As the metal compound which constitutes the solution of the metal compound, an organometal compound, an organic acid-metal compound, or a metal salt (for example, chloride, nitride or acetate) can be mentioned, for example. The solution of the organic acid-metal compound can be one obtained by dissolving an organotin compound, organoindium compound, organozinc compound or organoantimony compound in an acid (e.g., hydrochloric acid, nitric acid or sulfuric acid) and then diluting the resultant solution with an organic solvent (e.g., toluene, butyl acetate or isopropyl alcohol). The solution of the organometal compound can be, for example, one obtained by dissolving an organotin compound, organoindium compound, organozinc compound or organoantimony compound in an organic solvent (e.g., toluene, butyl acetate or isopropyl alcohol). It is preferred to have such a composition that, when the amount of the solution is assumed to be 100 parts by weight, the carbon nanotube structure or the like and the metal compound are contained in 0.001 to 20 parts by weight and 0.1 to 10 parts by weight, respectively. A dispersant and/or a surfactant may be contained in the solution. From the viewpoint of providing the matrix with an increased thickness, an additive, for example, carbon black or the like, may be added in the solution of the metal compound. In some instances, water may be used as a solvent in place of the organic solvent.

As a method for coating the cathode electrodes with the solution of the metal compound in which the carbon nanotube structure or the like is dispersed, spraying, spin coating, dipping, die quarter method or screen printing can be mentioned, for example. The adoption of spraying out of these methods is preferred from the viewpoint of ease in coating.

After the solution of the metal compound in which the carbon nanotube structure or the like is dispersed is coated on the cathode electrodes, the solution of the metal compound is dried to form a layer of the metal compound. The metal compound may be fired after the unnecessary parts of the layer of the metal compound on the cathode electrodes is removed, the unnecessary parts of the layer of the metal compound on the cathode electrodes may be removed after the metal compound is fired, or the solution of the metal compound may be coated only on desired regions of the cathode electrodes.

The firing temperature of the metal compound may be, for example, such a temperature that a metal salt can be oxidized into a metal oxide having electrical conductivity, or such a temperature that an organometal compound or organic acid-metal compound can be decomposed to form a matrix (for example, a metal oxide having electrical conductivity) which contains metal atoms forming the organometal compound or organic acid-metal compound. For example, it is preferred to set the firing temperature at 300° C. or higher. The upper limit of the firing temperature can be set at such a temperature that still no thermal damage or the like occurs on the field emission devices or the constituent elements of the cathode panel.

In the first formation process or second formation process of the carbon nanotube structure or the like, it is preferred from the viewpoint of achieving a still further improvement in the efficiency of electron emission from the electron-emitting portions to apply a kind of processing (washing processing) to the surfaces of the electron-emitting portions subsequent to the formation of the electron-emitting portions. As such processing, plasma processing in a gas atmosphere such as hydrogen gas, ammonia gas, helium gas, argon gas, neon gas, methane gas, ethylene gas, acetylene gas or nitrogen gas can be mentioned.

In the first formation process or second formation process of the carbon nanotube structure or the like, it is only necessary to form each electron-emitting portion at the surface of a portion of the associated cathode electrode, said portion being located in a bottom part of the corresponding hole or to form each electron-emitting portion such that it extends from a portion of the associated cathode electrode, said portion being located in a bottom part of the corresponding hole, to the surface of another portion of the cathode electrode, another portion being other than the bottom part of the corresponding hole. Further, each electron-emitting portion may be formed on the whole surface of the portion of the associated cathode electrode, said portion being located in the bottom part of the corresponding hole, or on a part of the surface of the portion of the associated cathode electrode.

Depending on the structure of each field emission device, a single electron-emitting portion may exist in a single hole arranged in the corresponding gate electrode and the insulating layer or plural electron-emitting portions may exist in a single hole arranged in the corresponding gate electrode and the insulating layer, or plural holes may be arranged in the corresponding gate electrode, a single hole may be arranged in the insulating layer such that the single hole is in communication with the plural holes, and one or plural electron-emitting portions may exist in the single hole arranged in the insulating layer.

The shape of each hole as viewed in plan (the shape of each hole when the hole is cut along an imaginary plane parallel to the surface of the support) can be any desired shape such as a circular shape, an elliptical shape, a rectangular shape, a polygonal shape or a rounded polygonal shape. The holes can be formed, for example, by isotropic etching or a combination of anisotropic etching and isotropic etching. Depending on the formation method of the gate electrodes or focusing electrodes, the holes may be directly formed in the gate electrodes or focusing electrodes. The formation of the holes in the insulating layer or interlayer insulating layer can also be conducted, for example, by isotropic etching or a combination of anisotropic etching and isotropic etching.

Between the cathode electrodes and the electron-emitting portions, a resistive material layer may be arranged. When the surfaces of the cathode electrodes serve as the electron-emitting portions, the cathode electrodes may be formed as a three-layer structure consisting of a conductive material layer, a resistive material layer, and an electron-emitting layer corresponding to the electron-emitting portions. The arrangement of the resistive material layer makes it possible to stabilize the operation of the electron-emitting devices and also to equalize their electron emission characteristics. Examples of the material that makes up the resistive material layer can include carbon-based materials such as silicon carbide (SiC) and SiCN, semiconductor materials such as SiN and amorphous silicon, and high-melting metal oxides such as ruthenium oxide ($RuO_2$), tantalum oxide and tantalum nitride. As a formation process of the resistive material layer, sputtering, CVD or screen printing can be mentioned, for example. Its resistivity can be set generally at $1\times10^5$ to $1\times10^7\Omega$, preferably at several MΩ.

In the anode panel, the sites, on which electrons emitted from the respective electron-emitting portions impinge, can be the anode electrode or phosphor regions, although this depends on the structure of the anode panel. The phosphor regions can be formed of monochromatic phosphor particles or trichromatic phosphor particles.

The shape (pattern) of the phosphor regions as viewed in plan may be in the form of dots or stripes arranged corresponding to the pixels (light-emitting regions). When the phosphor regions are formed between banks, the phosphor regions are formed on portions of the anode-panel-forming substrate, said portions being surrounded by the banks, respectively.

The banks have a function to prevent electrons, which are recoiled from the phosphor regions, or secondary electrons, which are emitted from the phosphor regions, from entering other phosphor regions and causing a so-called optical crosstalk (color turbidity). When electrons, recoiled from the phosphor regions or emitted from the phosphor regions, have flown toward other phosphor regions, the banks also have a function to prevent these electrons from impinging on the other phosphor regions.

As the shape of each bank as viewed in plan, it is possible to mention a grid shape (the shape of parallel crosses), specifically, a shape that surrounds the corresponding phosphor region, which corresponds to a single pixel and is in a substantially rectangular (dot-like) form as viewed in plan, at four sides thereof; or a band shape or stripe shape which extends in parallel with the opposing two sides of a substantially rectangular or stripe-shaped phosphor region. When each bank is arranged in a grid shape, it may be formed into such a shape that the corresponding single phosphor region is surrounded at its four sides either continuously or discontinuously. When each bank is arranged in a band shape or stripe shape, it may be formed into a continuous shape or a discontinuous shape. Subsequent to the formation of the banks, they can be ground to planarize their top walls.

In the cold cathode field electron emission display device, the space sandwiched between the anode panel and the cathode panel is in a vacuum state. Unless spacers are arranged between the anode panel and the cathode panel, the cold cathode field electron emission display device would be damaged under the atmospheric pressure. For example, such spacers can be formed of ceramics. When forming the spacers with ceramics, examples of the ceramics can include mullite, alumina, barium titanate, lead titanium zirconium, zirconia, cordiorite, barium borosilicate, iron silicate, glass ceramic materials, and those obtained by adding titanium oxide, chromium oxide, iron oxide, vanadium oxide and/or nickel oxide to them. In this case, the spacers can be produced by forming a so-called green sheet, firing the green sheet, and then cutting the thus-fired product of the green sheet. On the surfaces of the spacers, layers of an electrically conductive material such as a metal or alloy can be formed, resistive material layers can be formed, or thin layers, made of a material having a low secondary electron emission factor, can be formed. The spacers can be fixed, for example, holding them between the banks themselves. As an alternative, spacer-holding portions may be formed, for example, on the anode panel, and the spacers may be held and fixed between the spacer-holding portions themselves.

From the viewpoint of making improvements in the contrast of displayed images, it is preferred to form a light-absorbing layer, which absorbs light from the phosphor regions, between the banks and the substrate. In this construction, the light-absorbing layer functions as a so-called black matrix. As a material which makes up the light-absorbing layer, it is preferred to select a material which can absorb 99% or more of light from the phosphor regions. Examples of such a material can include carbon, thin films of metals (for example, chromium, nickel, aluminum and molybdenum, and their alloys), metal oxides (for example, chromium oxide), metal nitrides (for example, chromium nitride), heat-resistant organic resins, glass paste, and glass pastes containing black pigment or electrically conductive particles such as silver. Specific examples can include photosensitive polyimide resins, chromium oxide, and stacked chromium oxide/chromium film. In the case of stacked chromium oxide/chromium film, the chromium film is supposed to be in contact with the substrate. The light-absorbing layer can be formed by a process or processes selected as desired depending on the employed material, for example, a combination of vacuum deposition, sputtering or spin coating and a lift-off process, screen printing, a lithographic technique, or the like. It is to be noted that, when the spacer-holding portions or banks are formed on the anode electrode, the light-absorbing layer can be formed between the substrate and the anode electrode or between the anode electrode and the spacer-holding portions.

The phosphor regions can be formed by using a luminescent crystalline particle composition prepared from luminescent crystalline particles (for example, phosphor particles of 5 to 10 nm or so in particle size), for example, coating a red-color-sensitive, luminescent crystalline particle composition (red phosphor slurry) on the entire surface, and exposing and developing the composition to form red-color-emitting phosphor regions; coating a green-color-sensitive, luminescent crystalline particle composition (green phosphor slurry) on the entire surface, and exposing and developing the composition to form green-color-emitting phosphor regions; and then coating a blue-color-sensitive, luminescent crystalline particle composition (blue phosphor slurry) on the entire surface, and exposing and developing the composition to form blue-color-emitting phosphor regions.

As the phosphor material which forms the luminescent crystalline particles, a suitable phosphor material can be selected from conventionally-known phosphor materials and can be used. In the case of displaying in colors, it is preferred to combine phosphor materials which have color purities close to the primaries specified by the NTSC, can achieve a white balance when the primaries are mixed, are short in persistence time, and have primaries having substantially the same persistence time. Examples of the phosphor material which forms the red-color-emitting phosphor regions can include ($Y_2O_3$:Eu), ($Y_2O_2S$:Eu), ($Y_3Al_5O_{12}$:Eu), ($YBO_3$:Eu), ($YVO_4$:Eu), ($Y_2SiO_5$:Eu), ($Y_{0.96}P_{0.60}V_{0.40}O_4$:$Eu_{0.04}$) [(Y,Gd)$BO_3$:Eu], ($GdBO_3$:Eu), ($ScBO_3$:Eu), (3.5MgO.0.5$MgF_2$.$GeO_2$:Mn), ($Zn_3(PO_4)_2$:Mn), ($LuBO_3$:Eu), and ($SnO_2$:Eu). Examples of the phosphor material which forms the green-color-emitting phosphor regions can include ($ZnSiO_2$:Mn), ($BaAl_{12}O_{19}$:Mn), ($BaMg_2Al_{16}O_{27}$:Mn), ($MgGa_2O_4$:Mn) ($YBO_3$:Tb), ($LuBO_3$:Tb), ($Sr_4Si_3O_8Cl_4$:Eu), (ZnS:Cu,Al), (ZnS:Cu,Au,Al) ($ZnBaO_4$:Mn), ($GbBO_3$:Tb), ($Sr_6SiO_3Cl_3$:Eu) ($BaMgAl_{14}O_{23}$:Mn), ($ScBO_3$:Tb), ($Zn_2SiO_4$:Mn), (ZnO:Zn), ($Gd_2O_2S$:Tb), and ($ZnGa_2O_4$:Mn). Examples of the phosphor material which forms the blue-color-emitting phosphor regions can include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu), ($Sr_2P_2O_7$:Sn) (ZnS:Ag,Al), (ZnS:Ag), ZnMgO, and $ZnGaO_4$.

As the constituent material of the anode electrode, a suitable material can be selected as desired depending on the construction of the cold cathode field electron emission display device. Described specifically, when the cold cathode field electron emission display device is of the transmission type (the anode panel corresponds to a display surface) and the anode electrode and phosphor regions are stacked in this order on the substrate constituting the anode panel, the anode electrode itself is required to be transparent, to say nothing of the substrate, and a transparent, electrically-conductive material such as ITO (indium tin oxide) is used. When the cold cathode field electron emission display device is of the reflection type (the cathode panel corresponds to a display surface) or when the cold cathode field electron emission display device is of the reflection type but the phosphor regions and anode electrode are stacked in this order on the substrate, aluminum (Al) or chromium (Cr) can be used in addition to ITO. When the anode electrode is formed with aluminum (Al) or chromium (Cr), the thickness of the anode electrode can be, for example, specifically from $3\times10^{-8}$ m (30 nm) to $1.5\times10^{-7}$ m (150 nm), preferably from $5\times10^{-8}$ m (50 nm) to $1\times10^{-7}$ m (100 nm). The anode electrode can be formed by a deposition process or a sputtering process. It is to be noted that in the case of the latter, the anode electrode has a function as a reflection film for reflecting electrons recoiled from the phosphor regions or reflecting secondary electrons emitted from the phosphor regions and a function to prevent electrification of the phosphor regions, in addition to a function as a reflection film for reflecting light emitted from the phosphor regions.

In the cold cathode field electron emission display device, the anode electrode can be constructed in the form of a single sheet covering the valid region or can be constructed of an assembly of two or more anode electrode units also covering the valid region. The sizes of the individual anode electrode units may be the same irrespective of the positions of the anode electrode units or may differ, depending on the positions of the anode electrode units.

Construction examples of the anode electrode and phosphor regions can include (1) a construction that the anode electrode is formed on the substrate, and the phosphor regions are formed on the anode electrode, or (2) a construction that the phosphor regions are formed on the substrate, and the anode electrode is formed on the phosphor regions. It is to be noted that in the construction (1), a so-called metallic backing film can be formed in electrical conduction with the anode electrode over the phosphor regions. It is also to be noted that in the construction (2), a metallic backing film can be formed over the anode electrode.

When the cathode panel and the anode panel are joined together at and along their peripheral edge portions, the joining can be conducted with an adhesive layer or can be performed making combined use of a frame, made of an insulating rigid material such as glass or ceramics, and an adhesive layer. In the case of the combined use of the frame and the adhesive layer, the distance between the cathode panel and the anode panel can be set longer than the single use of the adhesive layer by selecting a suitable height as the height of the frame. As the constituent material of the adhesive layer, frit glass is common, but a so-called low melting-point metal material, the melting point of which is 120 to 400° C. or so, may also be used. Examples of such a low melting-point metal material can include In (indium, melting point: 157° C.); indium-gold-based, low melting-point alloys; tin(Sn)-based high-temperature solders such as $Sn_{80}Ag_{20}$ (melting point: 220 to 370° C.) and $Sn_{95}Cu_5$ (melting point: 227 to 370° C.); lead(Pb)-based high-temperature solders such as $Pb_{97.5}Ag_{2.5}$ (melting point: 304° C.), $Pb_{94.5}Ag_{5.5}$ (melting point: 304 to 365° C.) and $Pb_{97.5}Ag_{1.5}Sn_{1.0}$ (melting point: 309° C.); zinc(Zn)-based high-temperature solders such as $Zn_{95}Al_5$ (melting point: 380° C.); tin-lead-based, standard solders such as $Sn_5Pb_{95}$ (melting point: 300 to 314° C.) and $Sn_2Pb_{95}$ (melting point: 316 to 322° C.) and brazing filler metals such as $Au_{88}Ga$ (melting point: 381° C.) (the above suffixes all mean "atom %")

Upon joining together the three components of the substrate, support and frame, simultaneous three-component joining can be conducted, or as an alternative, one of the substrate and support and the frame can be firstly joined together in a first stage, followed by the joining the other one of the substrate and support with the frame in a second stage. When the simultaneous three-component joining or the joining in the second stage is performed in a vacuum atmosphere, the space surrounded by the substrate, support, frame and adhesive layer is brought into a vacuum at the same time as the joining. As an alternative, subsequent to the completion of the joining of the three components, the space surrounded by the substrate, support, frame and adhesive layer can be evacuated into a vacuum. When the evacuation is performed after the joining, the pressure of an atmosphere at the time of the joining can be either normal pressure or a reduced pressure, and the gas that constitutes the atmosphere can be the air or an inert gas containing nitrogen gas or a gas (for example, Ar gas) which belongs to Group 0 of the periodic table.

When the evacuation is performed after the joining, the evacuation can be effected through a tip tube connected beforehand to the substrate and/or the support. The tip tube is typically formed using a glass tube, is joined to a periphery of a through-hole arranged at an invalid region (namely, a region other than a valid region which functions as a display section) with frit glass or the above-mentioned low melting-point metal material, and, after the space has reached a predetermined degree of vacuum, is sealed and cut off by fusion under heat. It is to be noted that any residual gas can be released into the space when the cold cathode field electron emission display device is once heated and then cooled before conducting the sealing and cut-off. This procedure is suited because the residual gas can be taken out of the space by evacuation.

In the present invention, (1) when the input value is not smaller than the first reference value, the first switching circuit is maintained in an ON state for a predetermined duration shorter than the fixed duration on a basis of the output from the comparator, and during the predetermined duration, a first voltage $V_1$ is applied to the data electrode in the $n^{th}$ column (or, the $n^{th}$ cathode electrode or gate electrode); and (2) when the input value is not greater than the second reference value, the second switching circuit is maintained in an ON state for a predetermined duration shorter than the fixed duration on a basis of the output from the comparator, and during the predetermined duration, a second voltage $V_2$ is applied to the data electrode in the $n^{th}$ column (or, the $n^{th}$ cathode electrode or gate electrode). Described specifically, when the difference between the value of data for controlling the state of light emission at each light-emitting region constituted by a scanning electrode or the value of data for controlling the state of light emission at each of a multiple number N of electron-emitting regions constituted by a gate electrode and cathode electrode and the value of data preceding the above-mentioned value by one sequence is not smaller than the first reference value or not greater than the second reference value, the actuation driver operates and functions as a kind of compensation circuit that compensates for the leading-edge and trailing-edge waveforms of a voltage to be applied to the electrode. Accordingly, the leading-edge and trailing-edge waveforms of the voltage to be applied to the electrode can be made steep. As a result, it is possible to improve the response for the display of an image and hence, to achieve a smooth display of the image. Moreover, an increase in power to be consumed in the fixed pixel display device or cold cathode field electron emission display device can be reduced because the duration (time) during which the first voltage $V_1$ or the second voltage $V_2$ is applied to the data electrode in the $n^{th}$ column (or the $n^{th}$ cathode electrode or gate electrode) is shorter than the fixed duration. In addition, an image with its contour emphasized can be obtained, thereby bringing about a still further merit that an increased degree of sharpness is available on an image to be visualized.

BEST MODES FOR CARRYING OUT THE INVENTION

With reference to the drawings, the present invention will hereinafter be described based on examples. It is, however, to be noted that fixed pixel display devices and cold cathode field electron emission display devices, each of which can make steep the leading-edge and trailing-edge waveforms of voltages to be impressed on data electrodes or the like, can be achieved without significantly modifying the constructions or structures of conventional fixed pixel display devices or cold cathode field electron emission display devices, more specifically by practically adding only switching circuits and subtraction circuits.

EXAMPLE 1

Example 1 relates to a fixed pixel display device, according to the present invention, and also to a cold cathode field electron emission display device, according to a first embodiment of the present invention.

Figure 1:
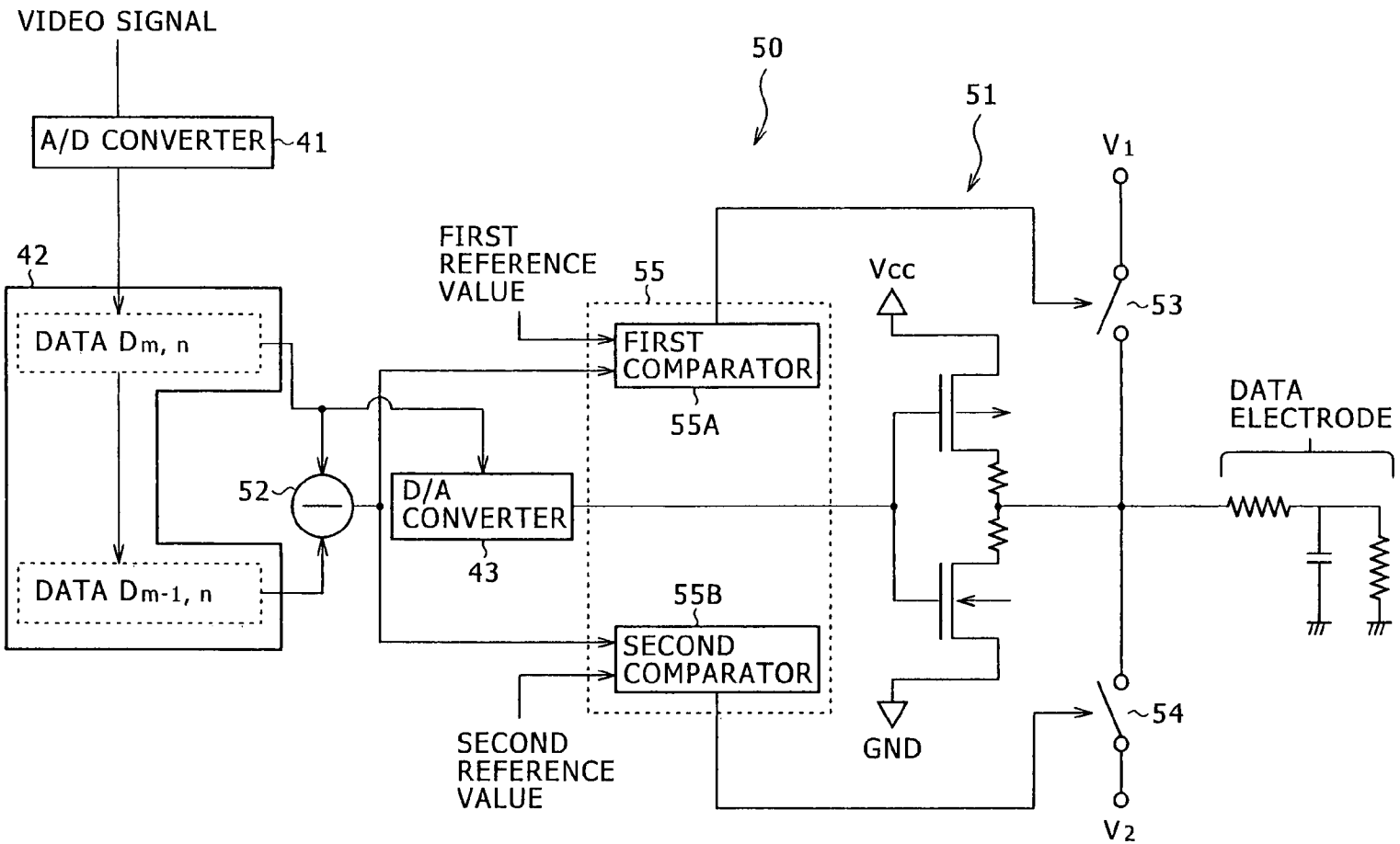
FIG. 1 is a circuit diagram of an actuation driver and the like in a fixed pixel display device or cold cathode field electron emission display device of Example 1.
Figure 2:
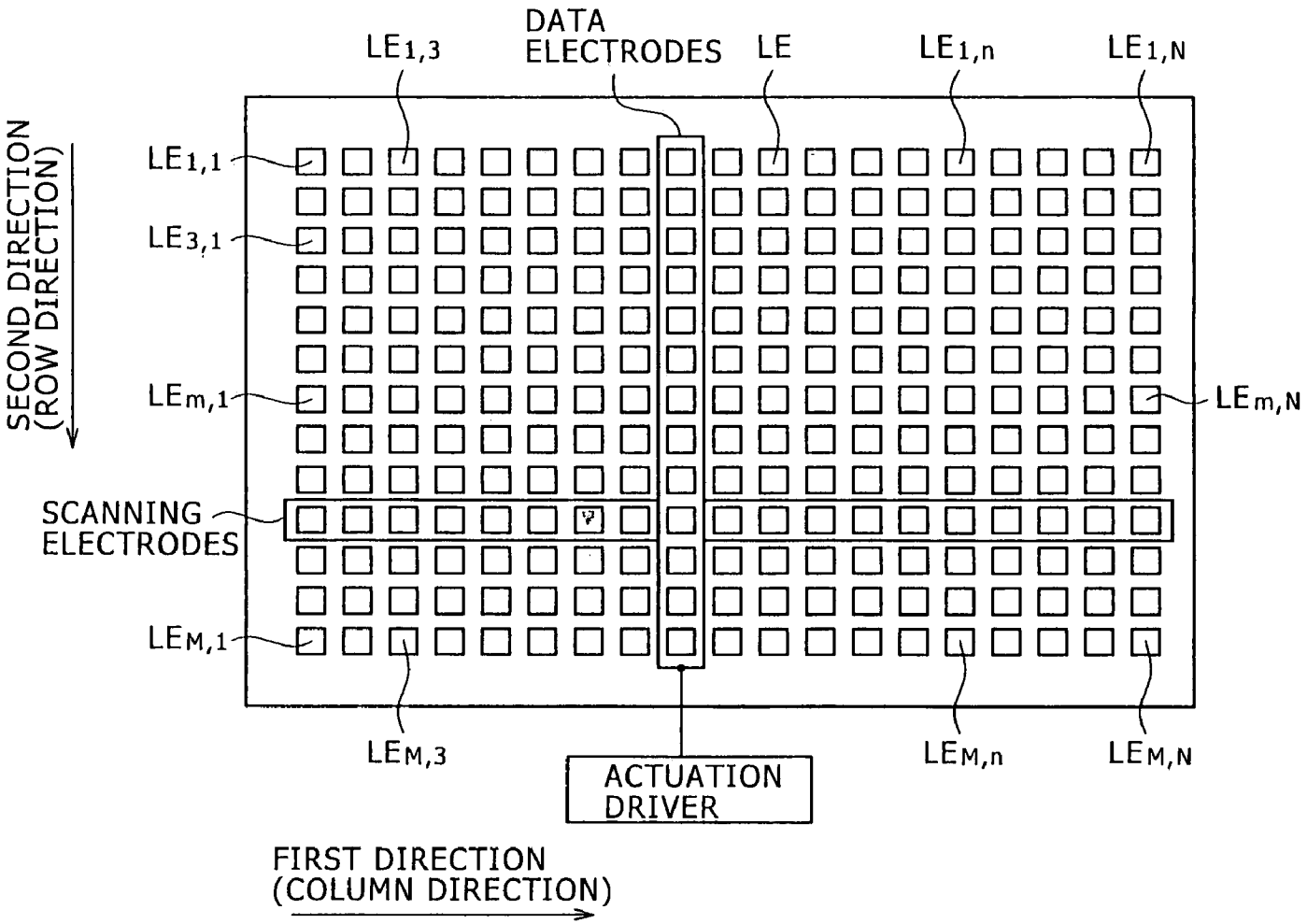
FIG. 2 is a conceptual diagram of the fixed pixel display device of Example 1.
Figures 3, 3A, 3B:
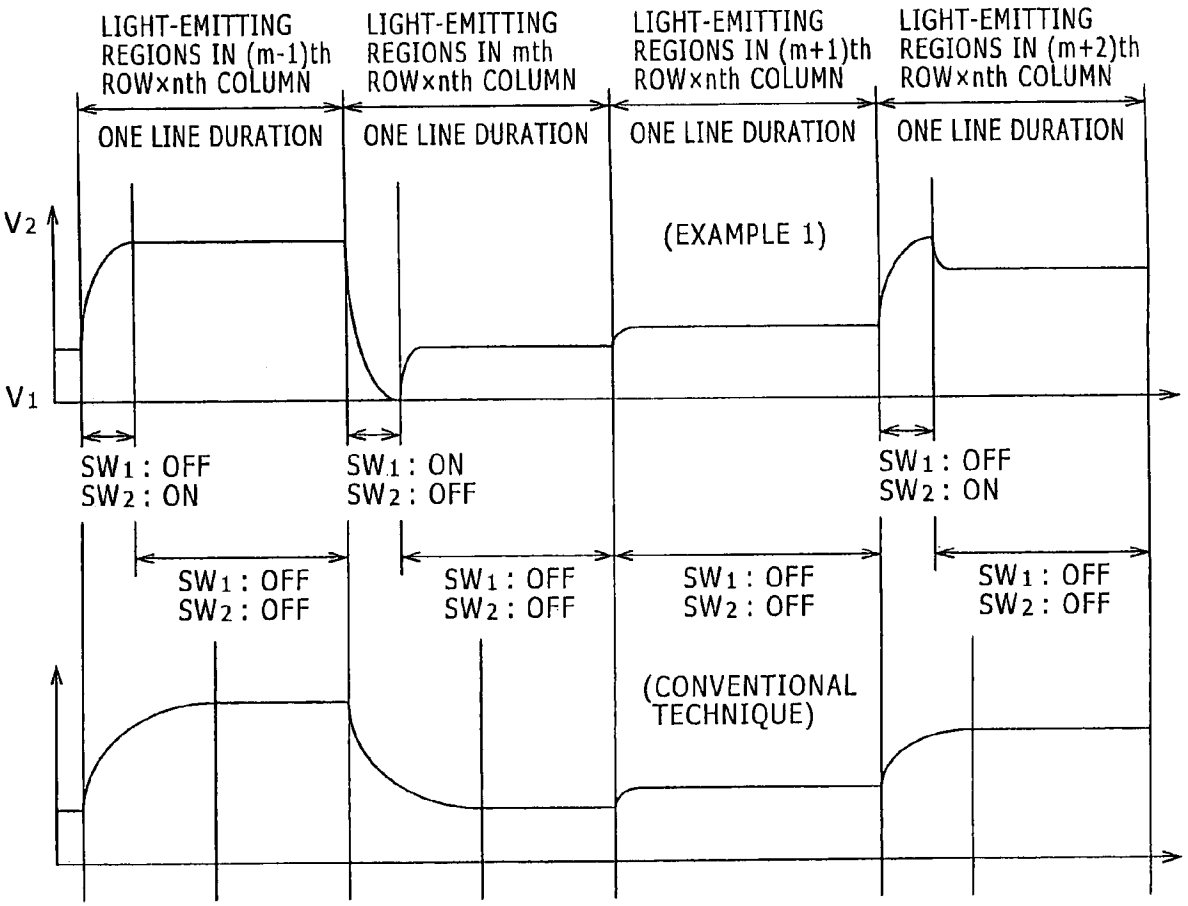
FIG. 3 is a diagram schematically illustrating the state of application of a voltage to an electrode (more specifically, a cathode electrode) in the fixed pixel display device or cold cathode field electron emission display device of Example 1.
Figure 5:
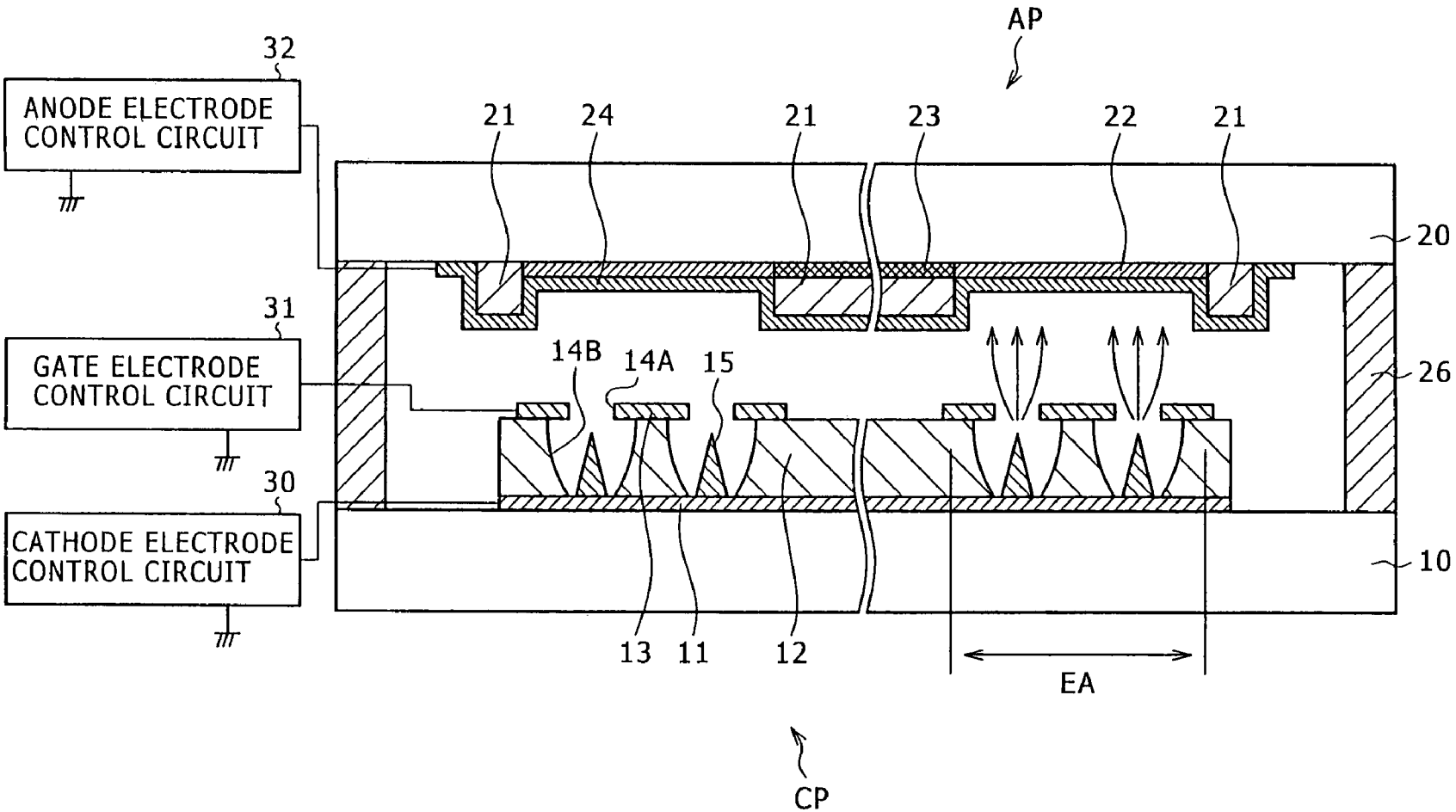
FIG. 5 is a schematic fragmentary end view of the cold cathode field electron emission display device of Example 1.
Figure 6:
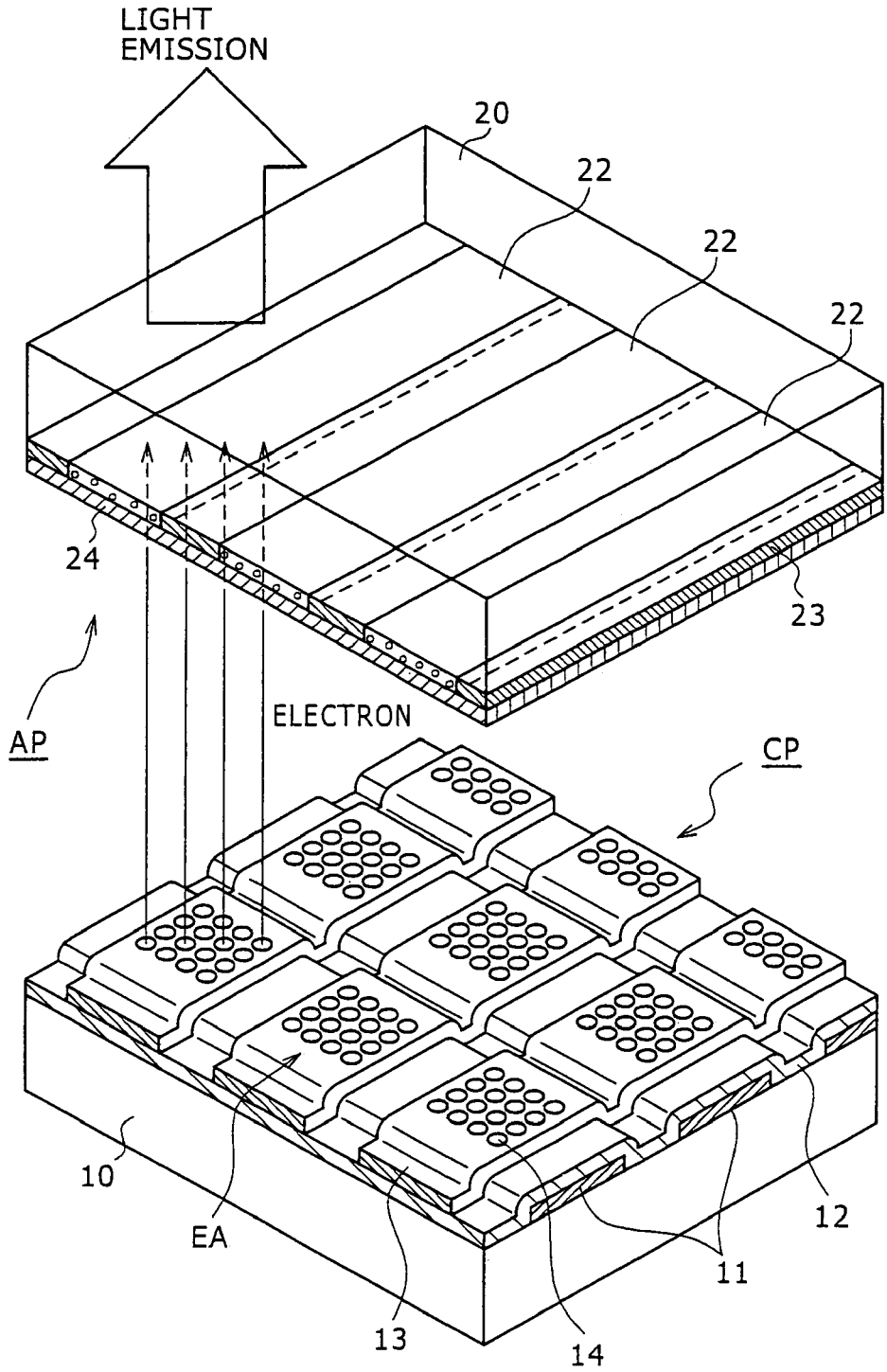
FIG. 6 is an exploded, schematic partial perspective view of a cathode panel and anode panel which constitute the cold cathode field electron emission display device of Example 1.
Figure 7:
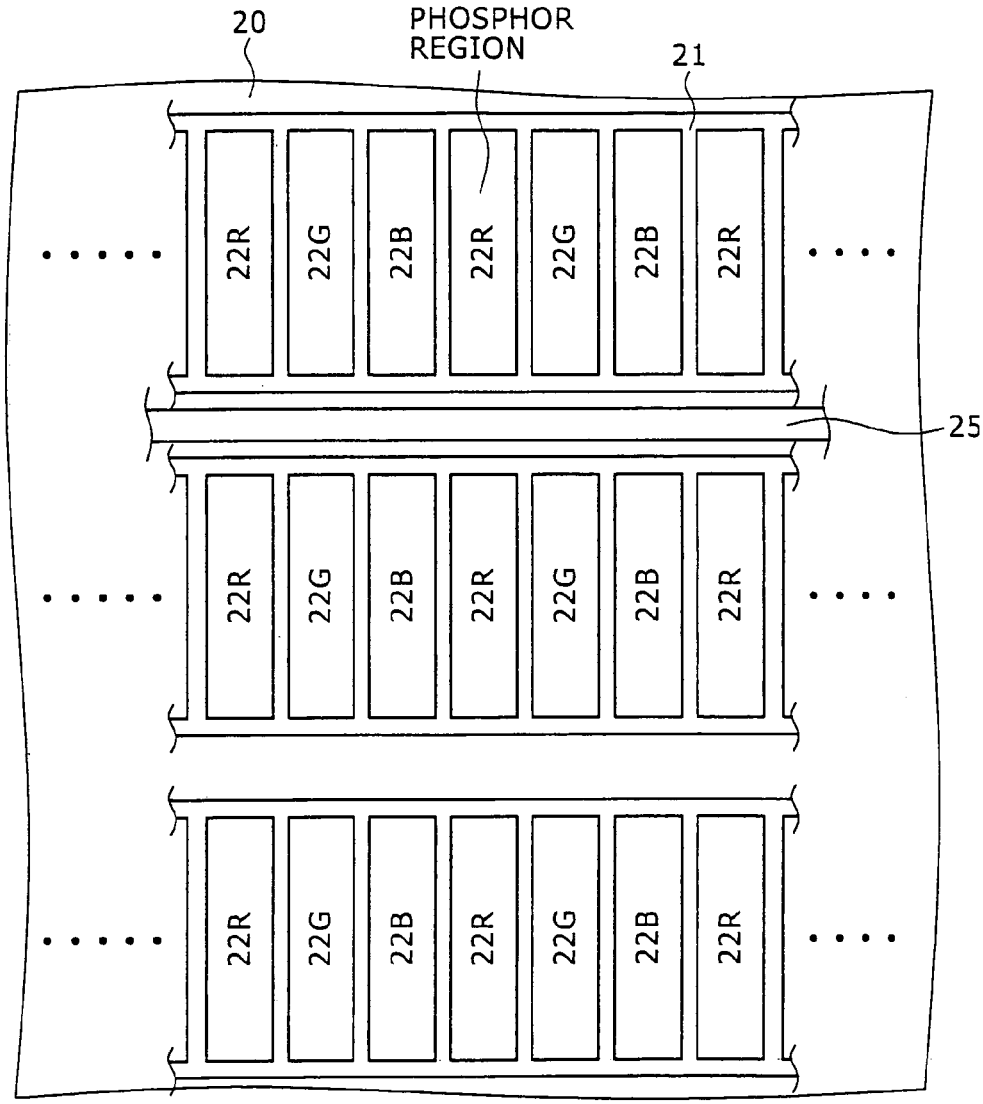
FIG. 7 is a layout plan schematically illustrating the arrangement of banks, spacers and phosphor regions in the anode panel which constitutes a cold cathode field electron emission display device.
Figure 8:
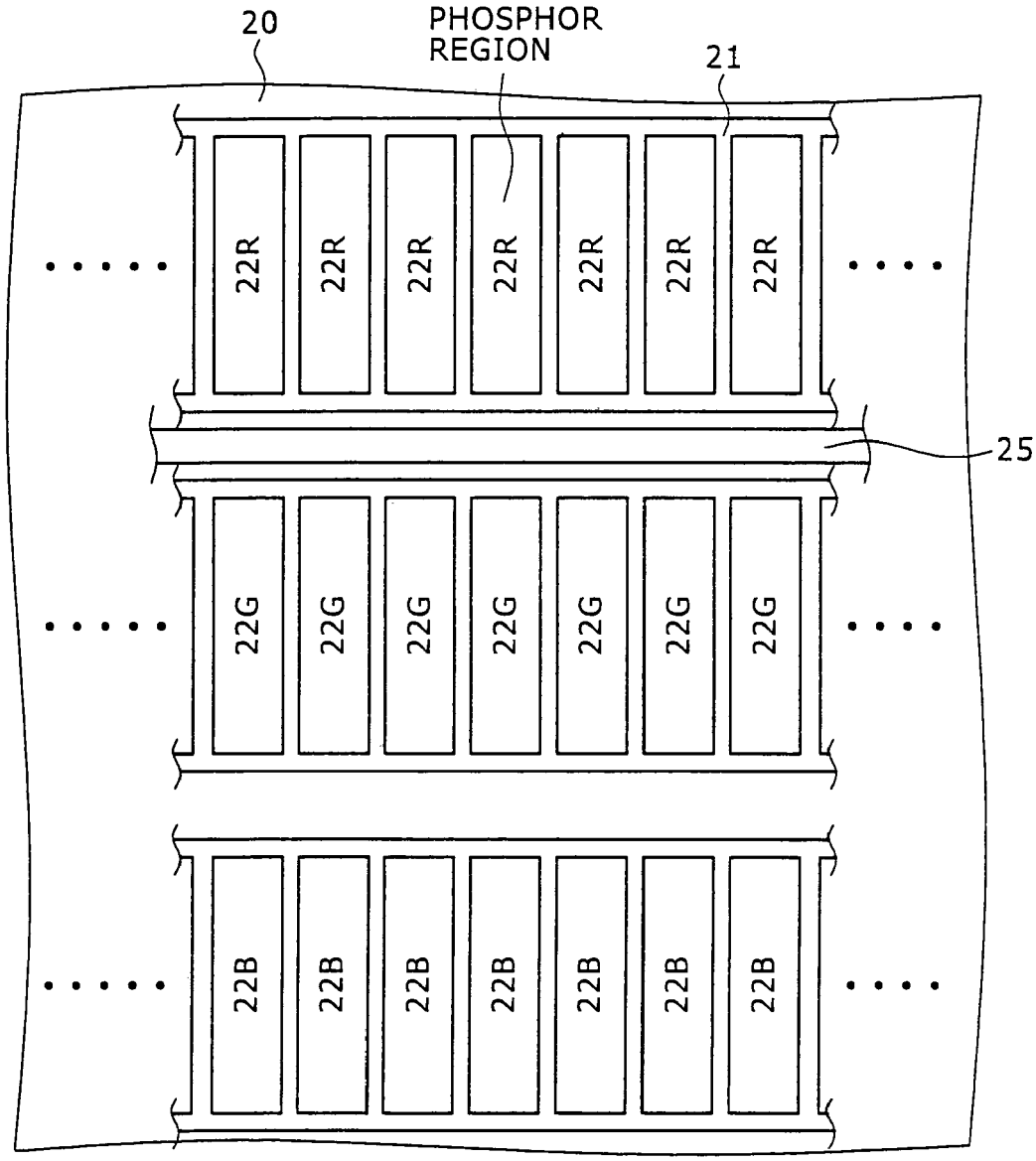
FIG. 8 is a layout plan schematically illustrating the arrangement of banks, spacers and phosphor regions in the anode panel which constitutes another cold cathode field electron emission display device.
Figure 9:
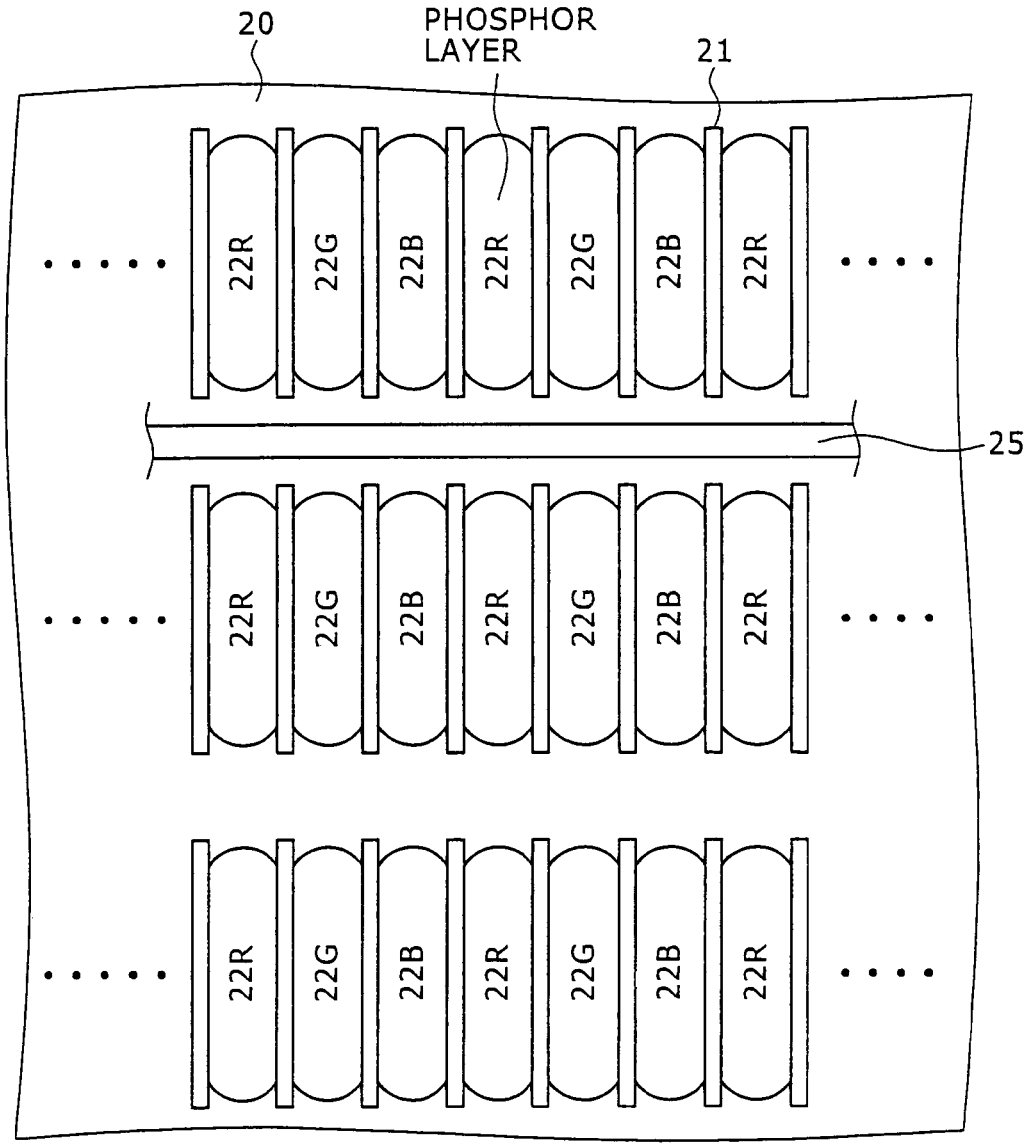
FIG. 9 is a layout plan schematically illustrating the arrangement of banks, spacers and phosphor regions in the anode panel which constitutes a further cold cathode field electron emission display device.
Figure 10:
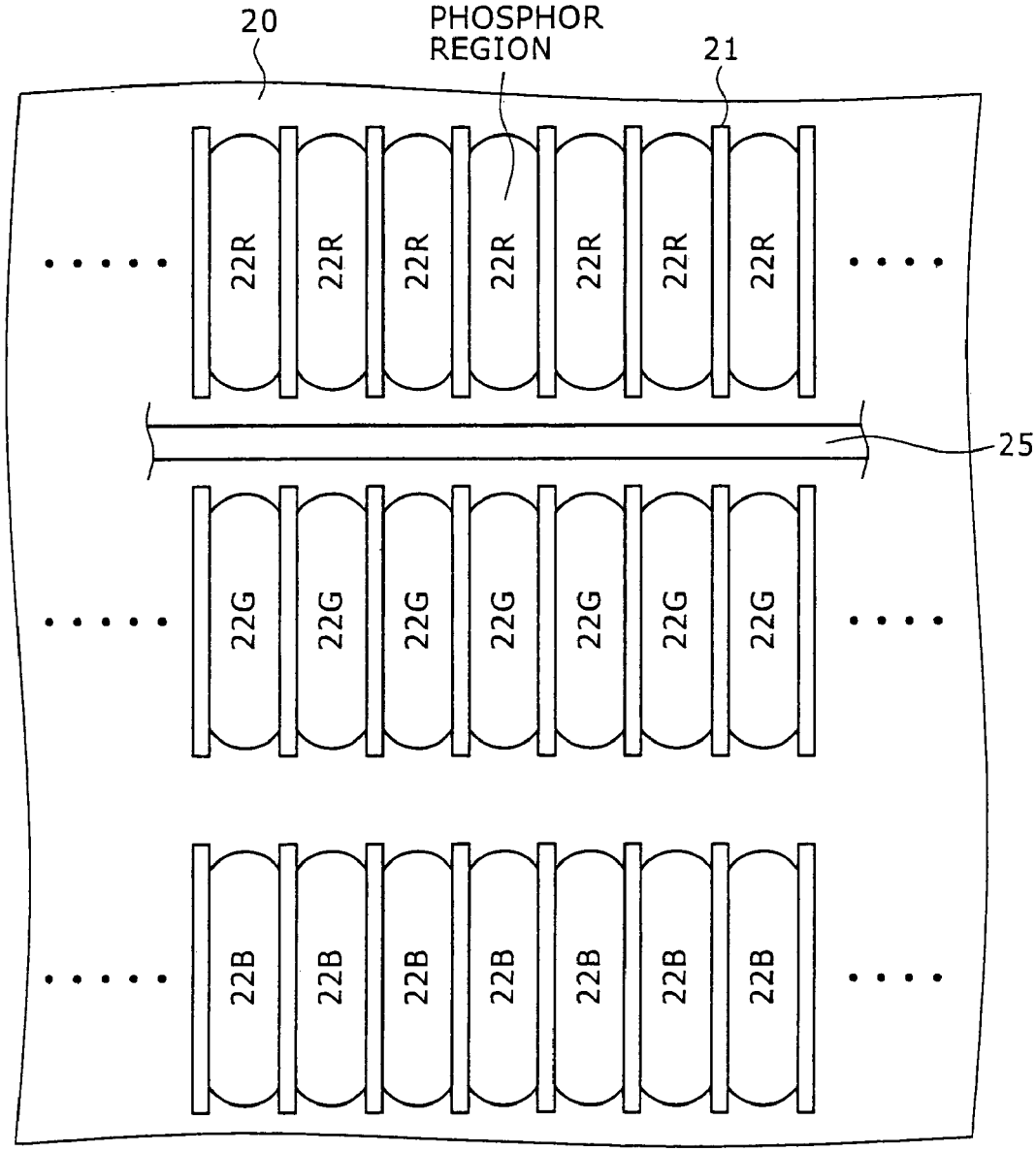
FIG. 10 is a layout plan schematically illustrating the arrangement of banks, spacers and phosphor regions in the anode panel which constitutes another cold cathode field electron emission display device.

A circuit diagram of an actuation driver and the like in Example 1 is shown in FIG. 1, a conceptual diagram of the fixed pixel display device of Example 1 is illustrated FIG. 2, and the state of application of a voltage on a data electrode (cathode electrode) in the fixed pixel display device or cold cathode field electron emission display device (which may hereinafter be collectively called simply "display") of Example 1 is schematically depicted in FIG. 3. Further, a schematic fragmentary end view of the cold cathode field electron emission display device of Example 1 is shown in FIG. 5, an exploded, schematic fragmentary perspective view of a cathode panel CP and anode panel AP is illustrated in FIG. 6, and as schematic fragmentary plan views, layouts of phosphor regions and the like are depicted by way of example in FIG. 7 through FIG. 10. It is to be noted that the layout of phosphor regions and the like in a schematic fragmentary end view of the anode panel AP is constructed as illustrated in FIG. 9 or FIG. 10.

The fixed pixel display device of Example 1 is equipped, as its conceptual diagram is shown in FIG. 2, with a multiple number M ($M \geqq 2$) of stripe-shaped scanning electrodes extending in a first direction (in Example 1, the scanning electrodes correspond to gate electrodes to be described subsequently herein), and a multiple number N($N \geqq 2$) of stripe-shaped data electrodes extending in a second direction different from the first direction (in Example 1, the data electrodes correspond to cathode electrodes to be described subsequently herein), and light-emitting regions LE, formed of overlap regions between the scanning electrodes and the data electrodes, are arrayed in a two-dimensional matrix form of M rows×N columns. To actuate the data electrodes, actuation drivers 50, connected to the respective data electrodes, are provided. These actuation drivers 50 are arranged as many as N.

On the other hand, the cold cathode field electron emission display device of Example 1 is constructed of the cathode panel CP and the anode panel AP joined together at their peripheral edge portions. A space sandwiched between the cathode panel CP and the anode panel AP is maintained in a vacuum state.

The cathode panel CP is formed of:

(a) a support 10, (b) a plurality number N($N \geqq 2$) of stripe-shaped cathode electrodes 11 formed on the support 10 and extending in the first direction (in a direction parallel to the sheet of FIG. 5), (c) an insulating layer 12 formed over the support 10 and cathode electrodes 11, (d) a plural number M ($M \geqq 2$) of stripe-shaped gate electrodes 13 formed on the insulating layer 12 and extending in the second direction different from the first direction (in a direction perpendicular to the sheet of FIG. 5), and (e) electron-emitting regions EA located at overlap regions between the cathode electrodes 11 and the gate electrodes 13.

The anode panel AP, on the other hand, is constructed of a substrate 20, and phosphor regions 22 arranged corresponding to the respective electron-emitting regions EA (when displaying in colors, red-color-emitting phosphor regions 22R, green-color-emitting phosphor regions 22G, blue-color-emitting phosphor regions 22B) and anode electrode 24 covering the phosphor regions 22, said phosphor regions and anode electrode being formed on the substrate 20.

More specifically, the anode panel AP is equipped with the substrate 20, a number of the phosphor regions 22 formed of phosphor particles (the red-color-emitting phosphor regions 22R, green-color-emitting phosphor regions 22G, blue-color-emitting phosphor regions 22B) formed on the substrate 20 at areas between banks 21, themselves formed on the substrate 20, and the anode electrode 24 formed on the phosphor regions 22. The anode electrode is in the form of a single thin sheet covering the valid region, and is connected to an anode electrode control circuit 32. The anode electrode 24 is formed of aluminum of about 70 nm in thickness, and is arranged in such a state as covering the banks 21. Between the phosphor regions 22 themselves and between the banks 21 and the substrate 20, a light-absorbing layer (black matrix) 23 is formed. Examples of the layout of the banks 21, spacers 25 and the phosphor regions 22 are schematically illustrated in FIG. 7 through FIG. 10. In the examples illustrated in FIG. 7 and FIG. 8, the banks 21 are formed in grid shapes (in the shapes of parallel crosses), and the phosphor regions 22 (the red-color-emitting phosphor regions 22R, green-color-emitting phosphor regions 22G, blue-color-emitting phosphor regions 22B) are in dot-shaped forms. In the examples illustrated in FIG. 9 and FIG. 10, on the other hand, the banks 21 as viewed in plan have band shapes (stripe shapes) that each bank extends in parallel to the opposing two sides of the corresponding, substantially rectangular phosphor region 22. It is to be noted that the phosphor regions 22 can also be formed in the shapes of stripes extending in a vertical direction in FIG. 7 or FIG. 9.

Further, each electron-emitting region EA is composed of an electron-emitting portion 15 located in a bottom part of its corresponding hole 14 arranged in the associated gate electrode 13 and the insulating layer 12 (an opening 14A arranged through the corresponding gate electrode 13 and a hole 14B arranged through the insulating layer 12). It is to be noted that in Example 1, each electron-emitting portion 15 is in a circular conical form. These gate electrodes 13 correspond to the scanning electrodes, these cathode electrodes 11 correspond to the data electrodes, and these electron-emitting regions EA correspond to parts of the light-emitting regions. It is also to be noted that the first direction and the second direction intersect at right angles with each other. In other words, a projection image of the scanning electrodes (gate electrodes 13) and a projection image of the data electrodes (cathode electrodes 11) intersect at right angles with each other. Scanning signals are inputted to the gate electrodes 13, while video signals (chrominance signals) are inputted to the cathode electrodes 11.

Specifically, the cold cathode field electron emission devices (hereinafter abbreviated as "the field emission devices) in the display of Example 1 are each formed of:

(a) the stripe-shaped cathode electrode 11 formed on the support 10 and extending in the first direction, (b) the insulating layer 12 formed over the support 10 and cathode electrodes 11, (c) the stripe-shaped gate electrode 13 formed on the insulating layer 12 and extending in the second direction different from the first direction, (d) the hole 14 arranged in the gate electrode 13 and insulating layer 12, and (e) the electron-emitting portion 15 located in a bottom part of the hole. More specifically, each field emission device is a Spindt-type field emission device in which the conical electron-emitting portion 15 is arranged on the associated cathode electrode 11 located in the bottom part of the corresponding hole 14.

By the plural electron-emitting regions 15 arranged at the regions (overlap regions) where a projection image of the cathode electrodes 11 and a projection image of the gate electrodes 13 overlap with each other, the electron-emitting regions EA are constructed respectively. As illustrated in FIG. 6, that is, the schematic fragmentary perspective view of the cathode panel CP and anode panel AP, the electron-emitting regions EA corresponding to the regions of individual pixels are arrayed in a two-dimensional matrix form in the valid region of the cathode panel CP. Each light-emitting region (a single pixel or a single subpixel) is formed of an electron-emitting region EA on the side of the cathode panel and a phosphor region 22 formed on the side of the anode panel and facing the electron-emitting region EA. In the valid region, such light-emitting regions (pixels or subpixels) are arrayed, for example, on an order as many as several hundred thousands to several millions.

A strong electric field, which has been produced by a voltage applied to each cathode electrode 11 and its corresponding cathode electrode 13, is applied to the electron-emitting portion 15 forming the corresponding light-emitting region. As a result, electrons are emitted from the electron-emitting portion 15 under the quantum tunnel effect, and impinge on the anode electrode 24. In other words, an emitted electron current flows from the anode electrode 24 to the cathode electrode 11. It is to be noted that in FIG. 6, the illustration of the banks 21 and spacers 25 is omitted.

The cold cathode field electron emission display device of Example 1 is also equipped with the actuation drivers 50 connected to the respective cathode electrodes 11 to actuate the cathode electrodes 11.

Each actuation driver 50 is formed of the switching circuit, an output circuit 51, and a subtraction circuit 52. A cathode electrode control circuit 30, connected to the cathode electrodes 11, is formed of the multiple number N of actuation drivers 50 and the multiple number N of D/A converters 43 of, for example, 8 bits. Further, a gate electrode control circuit 31, to which the gate electrodes 13 are connected, is composed of a known power supply for applying a fixed voltage $V_G$ to the gate electrodes 13 and an output circuit for the scanning electrodes.

Each switching circuit is provided with:

(A) a first switching circuit 53 (which may be indicated by a sign "$SW_1$" as shown in FIG. 3) for applying the first voltage $V_1$ to the data electrodes (cathode electrodes 11), (B) a second switching circuit 54 (which may be indicated by a sign "$SW_2$" as shown in FIG. 3) for applying the second voltage $V_2$ ($V_2$#$V_1$, more specifically $V_2>V_1$ in Example 1) to the data electrodes (cathode electrodes 11), and (C) a comparator 55 (comparators 55A, 55B) for performing on/off control of the first switching circuit 53 and second switching circuit 54.

The first switching circuit 53 and second switching circuit 54 may each be composed of NMOS-FET, and the subtraction circuit 52 and comparator 55 may be composed of a known subtraction circuit and comparator, respectively.

In the display of Example 1, a voltage, outputted from the output circuit 51 on the basis of the value $D_{m,n}$ (m: any one of 2, 3, . . . M; n: 1, 2, . . . , N) of data (gradation control data) for controlling a state of light emission at each of the multiple number N of light-emitting regions formed by the scanning electrodes in the $m^{th}$ row upon displaying an image, is applied to the data electrodes in the $n^{th}$ column during the fixed duration. In other words, a voltage (0 volt to 15 volts), outputted from the output circuit 51 on the basis of the value $D_{m,n}$ (m: any one of 2, 3, . . . , M; n: 1, 2, . . . , N) of data (gradation control data) for controlling a state of electron emission at each of the multiple number N of electron-emitting regions EA formed by the $m^{th}$ gate electrodes 13, is applied to the $n^{th}$ cathode electrodes 11 during the fixed duration.

Described specifically, as illustrated in FIG. 1, video signals are inputted to the A/D converter 41 of, for example, 8 bits, and data $D_{m,n}$ as outputs from the A/D converter 41 are sequentially stored once in the line buffer 42 equipped with line buffers in two systems. The data $D_{m,n}$ stored in the line buffer 42 and corresponding to gradation control data are sequentially fed to the D/A converter 43, for example, of 8 bits which constitutes the $n^{th}$ actuation driver 50, and analog signals from the D/A converter 43 are inputted to the output circuit 51 which makes up the actuation driver 50 connected to the data electrodes in the $n^{th}$ column ($n^{th}$ cathode electrodes 11). In accordance with switching timing pulses (load signals), the scanning electrodes (gate electrodes 13) in the $1^{st}$ row to the $M^{th}$ row are line-sequentially actuated by the output circuit for the scanning electrodes so that, for example, the fixed voltage $V_G$(=35 volts) is sequentially applied to the scanning electrodes (gate electrodes 13). On the data electrodes (cathode electrodes 11) in the $n^{th}$ (n: 1, 2, . . . , N) column, on the other hand, a voltage $V_{DATA}$, which varies by a voltage modulation method in accordance with the gradation, is applied from the output circuit 51.

The output circuit 51 is a current buffer circuit composed of a CMOS circuit and is a circuit the voltage gain and current gain of which are 1 and greater than 1, respectively. Specifically, an input voltage to the output circuit 51 and an output voltage from the output circuit 51 are equal to each other, while an output current from the output circuit 51 is greater than an input current to the output circuit 51. One of the source/drain regions of the PMOS-FET which constitutes the output circuit 51 is connected to $V_{cc}$(=15 volts), the other source/drain region of the PMOS-FET is connected, together with one of the NMOS-FET which constitutes the output circuit 51, to the data electrode (cathode electrode 11), and the other source/drain region of the NMOS-FET, which constitutes the output circuit 51, is grounded. Further, the gate electrodes of the PMOS-FET and NMOS-FET, which constitute the output circuit 51, are connected to the D/A converter 43. The individual data electrodes (the individual cathode electrodes 11) are actuated by outputs from the respective output circuits 51. The outputs from these output circuits 51 are substantially the same as the voltage $V_{DATA}$ applied to the conventional data electrodes, as shown in FIG. 3B.

In the display of Example 1, a value ($D_{m,n}-D_{m-1,n}$, that is, gradation-controlling difference data), obtained by subtracting at the subtraction circuit 52 the value $D_{m-1,n}$ of data (gradation control data) for controlling the state of light emission at each of the light-emitting regions composed by the scanning electrodes in the $(m-1)^{th}$ row from the value $D_{m,n}$ of data (gradation control data) for controlling the state of light emission at each of the light-emitting regions composed by the scanning electrodes in the $m^{th}$ row, is inputted as an input value to the comparator 55 (more specifically, the first comparator 55A and the second comparator 55B). In other words, a value ($D_{m,n}-D_{m-1,n}$, that is, gradation-controlling difference data), obtained by subtracting at the subtraction circuit 52 the value $D_{m-1,n}$ of data (gradation control data) for controlling the state of electron emission at each of the electron-emitting regions EA composed by the $(m-1)^{th}$ gate electrodes 13 from the value $D_{m,n}$ of data (gradation control data) for controlling the state of electron emission at each of the electron-emitting regions EA composed by the $m^{th}$ gate electrodes 13, is inputted as an input value to the comparator 55 (more specifically, the first comparator 55A and the second comparator 55B). On the other hand, the first reference value is inputted to the first comparator 55A, and the second reference value is inputted to the second comparator 55B.

Described specifically, in Example 1, the fixed voltage $V_G$(=35 volts) is applied to the scanning electrodes (gate electrodes 13), while the voltage $V_C$(=0 volt to 15 volts) is applied to the data electrodes (cathode electrodes 11), in accordance with the gradation. To control the states of light emission at the light-emitting regions in the $(m-1)^{th}$ row×the $n^{th}$ column, the voltage $V_{DATA(m-1,n)}$ (the value of data at this time is $D_{m-1,n}$) is applied to the data electrodes, and to control the states of light emission at the light-emitting regions in the $m^{th}$ row×the $n^{th}$ column, the voltage $V_{DATA(m,n)}$ (the value of data at this time is $D_{m,n}$) is applied to the data electrodes. In other words, the voltage $V_{DATA(m-1,n)}$ (the value of data at this time is $D_{m-1,n}$) is applied to the gate electrodes 13 to control the states of electron emission at the $(m-1)^{th}$×$n^{th}$ electron-emitting regions, and the voltage $V_{DATA(m,n)}$ (the value of data at this time is $D_{m,n}$) is applied to the gate electrodes 13 to control the states of electron emission at the $m^{th}$×$n^{th}$ electron-emitting regions. The values $D_{m-1,n}$,$D_{m,n}$ of the data stored in the line buffer 42 are read and fed to the subtraction circuit 52, a value ($D_{m,n}-D_{m-1,n}$), obtained by performing a subtraction at the subtraction circuit 52, is inputted as an input value to the comparator 55 (the first comparator 55A and the second comparator 55B), and the input value ($D_{m,n}-D_{m-1,n}$), inputted to the comparator 55 (the first comparator 55A and the second comparator 55B), and the first reference value and second reference value are compared at the comparator 55.

Now assuming that the difference between the voltage applied to the scanning electrodes and the voltage applied to the data electrodes is ΔV in Example 1, the first voltage $V_1$ is a voltage to be applied to the data electrodes to obtain a maximum value of ΔV, while the second voltage $V_2$ is a voltage to be applied to the data electrodes to obtain a minimum value of ΔV. In Example 1, as the voltage to be applied to n the scanning electrodes is greater than the voltage to be applied to the data electrodes, $V_1<V_2$. In other words, when the difference between the voltage (for example, fixed at 35 volts) to be applied to the gate electrodes 13 and the voltage (for example, 0 volt to 15 volts depending on the gradation) to be applied to the cathode electrodes 11 is assumed to be $\Delta V_{GC}$, the first voltage $V_1$ is a voltage to be applied to the cathode electrodes 11 to obtain a maximum value (namely, 35 volts) of $\Delta V_{GC}$, while the second voltage $V_2$ is a voltage to be applied to the cathode electrodes 11 to obtain a minimum value (namely, 20 volts) of $\Delta V_{GC}$. Assuming that the first reference value is a value corresponding to a voltage $\alpha(V_2-V_1)$ and the second reference value is a value corresponding to a voltage $\beta(V_1-V_2)$, the value of α and the value of β are set at 0.5 and 0.5, respectively. Now, assuming that the value $D_{m,n}$ of data, as input digital data to the subtraction circuit 52, has 8 bits, 256-level gradation control is performed. Here, $D_{m,n}$=255 is supposed to represent the brightest screen data. If the value of ax and the value of β are supposed to become α' and β' when converted into 8-bit digital expressions, α'=128 and β'=128. In general, it is preferred to satisfy $32\leqq\alpha\leqq192$ and $32\leqq\beta'\leqq192$.

When the input value is not smaller than the first reference value, in other words, when $(D_{m,n}-D_{m-1,n})>\alpha'$ or $(D_{m,n}-D_{m-1,n})\geqq\alpha'$, the first switching circuit 53 is maintained in an ON state during a predetermined duration (for example, 5 microseconds) shorter than the fixed duration (for example, 25 microseconds) on the basis of an output from the first comparator 55A so that during the predetermined duration (for example, 5 microseconds), the first voltage $V_1$(=0 volt) is applied to the data electrodes in the $n^{th}$ column (the $n^{th}$ cathode electrodes 11). In FIG. 3A, this state is shown as the applied voltage $V_{DATA}$ on the data electrodes in the $m^{th}$ row× the $n^{th}$ column during a one-line duration.

When the input value is not greater than the second reference value, on the other hand, in other words, when $(D_{m,n}-D_{m-1,n})<\beta'$ or $(D_{m,n}-D_{m-1,n})\geqq\beta'$, the second switching circuit 54 is maintained in an ON state during a predetermined duration (for example, 5 microseconds) shorter than the fixed duration (for example, 25 microseconds) on the basis of an output from the second comparator 55B so that during the predetermined duration (for example, 5 microseconds), the second voltage $V_2$(=15 volts) is applied to the data electrodes in the $n^{th}$ column (the $n^{th}$ cathode electrodes 11). In FIG. 3A, this state is shown as the applied voltage $V_{DATA}$ on the data electrodes in the $(m-1)^{th}$ row×the $n^{th}$ column during a one-line duration and on the data electrodes in the $(m+_2)^{th}$ row×the $n^{th}$ column during a one-line duration.

When the input value is smaller than the first reference value but is greater than the second reference value, in other words, when $\beta'\leqq(D_{m,n}-D_{m-1,n})\leqq\alpha'$ or $\beta'<(D_{m,n}-D_{m-1,n})<\alpha'$, the first switching circuit 53 and second switching circuit 54 are maintained in OFF states, respectively.

In FIG. 3A, this state is shown as a one-line duration in the $(m+1)^{th}$ row×the $n^{th}$ column.

As has been described above, the leading-edge and trailing-edge waveforms of the voltage $V_{DATA}$ to be impressed on the data electrodes (cathode electrodes 11) immediately after the state of an application on the scanning electrodes is changed over, for example, from the $m^{th}$ row to the $(m+1)^{th}$ row (in other words, immediately after the state of an application to the gate electrodes 13 is changed over, for example, from the $m^{th}$ gate electrodes to the $(m+1)^{th}$ gate electrodes) can be made steep by additionally applying the voltages $V_1$, $V_2$. As a result, it is possible to improve the response for the display of an image and hence, to achieve a smooth display of the image. Moreover, an increase in power to be consumed in the fixed pixel display device or cold cathode field electron emission display device can be reduced because the duration (time) during which the first voltage $V_1$ or the second voltage $V_2$ is applied to the data electrodes in the $n^{th}$ column (or the $n^{th}$ cathode electrodes 11) is shorter than the fixed duration. In addition, an image with its contour emphasized can be obtained so that an increased degree of sharpness is available on an image to be visualized.

In Example 1, a voltage, outputted from the output circuit 51 on the basis of a value $D_{1,n}$ (n: 1, 2, . . . , N) of data for controlling a state of light emission at each of the multiple number N of light-emitting regions formed by the scanning electrodes in the $1^{st}$ row, is applied to the data electrodes in the $n^{th}$ column during the fixed duration. In other words, a voltage, outputted from the output circuit 51 on the basis of the value $D_{1,n}$ (n: 1, 2, . . . , N) of data for controlling a state of electron emission at each of the multiple number N of electron-emitting regions EA formed by the $1^{st}$ gate electrodes 13, is applied to the $n^{th}$ cathode electrodes 11 during the fixed duration. At this time, a value ($D_{1,n}$–$D_{0,n}$), obtained by subtracting at the subtraction circuit the value "0" of data (expressed as "the data value $D_{0,n}$") from the value $D_{1,n}$ of data for controlling the state of light emission at each of the light-emitting regions composed by the scanning electrodes in the $1^{st}$ row, is inputted as an input value to the comparator, and the input value, inputted in the comparator, is compared with the first reference value and second reference value at the comparator. Instead of using the data value $D_{0,n}$, the value $D_{M,n}$ of the immediately preceding data (the value of the last data in a frame preceding by one frame) can be also used. As an alternative, a value ($D_{1,n}$–$D_{0,n}$), obtained by subtracting at the subtraction circuit the value "0" of data (expressed as "the data value $D_{0,n}$") from the value $D_{1,n}$ of data for controlling the state of light emission at each of the multiple number N of electron-emitting regions composed by the first gate electrode, is inputted as an input value to the comparator, and the input value, inputted in the comparator, is compared with the first reference value and second reference value at the comparator. Instead of using the data value $D_{0,n}$, the value $D_{M,n}$ of the immediately preceding data (the value of the last data in a frame preceding by one frame) can be also used.

A fabrication process of Spindt-type field emission devices will hereinafter be described with reference to FIG. 11A through FIG. 11B and FIG. 12A through FIG. 12B, schematic fragmentary end views of a support 10 and the like which make up a cathode panel. It is, however, to be noted that the field emission devices in the cold cathode field electron emission display device, according to the present invention shall not be limited to Spindt-type field emission devices.

The Spindt-type field emission devices can each be obtained basically by a process that forms an electron-emitting portion 15 of a circular conical shape by surface normal deposition of a metal material. Described specifically, evaporated particles enter vertically with respect to openings 14A arranged through a gate electrode 13. Making use of the shielding effect of overhanging deposits formed in the vicinities of edges of the openings 14A, the amounts of evaporated particles to be allowed to reach bottom parts of holes 14B arranged through an insulating layer 12 are gradually reduced so that the electron-emitting portions 15 are self-aligningly formed as circular conical deposits. A description will now be made about a process which forms beforehand a strippable layer 16 over the gate electrode 13 and the insulating layer 12 to facilitate the removal of the unnecessary overhanging deposits. It is to be noted that only a single electron-emitting portion is shown in FIG. 11A through FIG. 11B and FIG. 12A through FIG. 12B.

[Step-A0]

After a cathode-electrode-forming conductive material layer, composed, for example, of polysilicon, is firstly formed as a film on a support 10, composed, for example, of a glass substrate by a plasma CVD process, the cathode-electrode-forming conductive material layer is patterned on the basis of a lithographic technique and a dry etching technique to form stripe-shaped cathode electrodes 11. On its entire surface, an insulating layer 12 made of $SiO_2$ is then formed by a CVD process.

[Step-A1]

On the insulating layer 12, a gate-electrode-forming conductive material layer (for example, a TiN layer), is formed by a sputtering method, and the gate-electrode-forming conductive material layer is then patterned by a lithographic technique and a dry etching technique, so that stripe-shaped gate electrodes 13 can be obtained. The stripe-shaped cathode electrodes 11 extend in a horizontal direction on the drawing sheet, while the stripe-shaped gate electrodes 13 extend in a direction perpendicular to the drawing sheet.

The gate electrodes 13 may be formed by a known thin-film fabrication technique such as PVD like vacuum deposition, CVD, a plating process such as electroplating or electroless plating, screen printing, laser abrasion, a sol-gel process or a lift-off process, optionally in combination with an etching technique. According to screen printing or a plating process, it is possible to directly form, for example, stripe-shaped gate electrodes.

[Step-A2]

Subsequently, a resist layer is formed again. Openings 14A are formed through the gate electrodes 13 by etching, holes 14B are then formed through the insulating layer 12 to expose the cathode electrode 11 in bottom parts of the respective holes 14B, and subsequently, the resist layer is removed. As a result, the structure shown in FIG. 11A can be obtained.

[Step-A3]

Figure 11A:
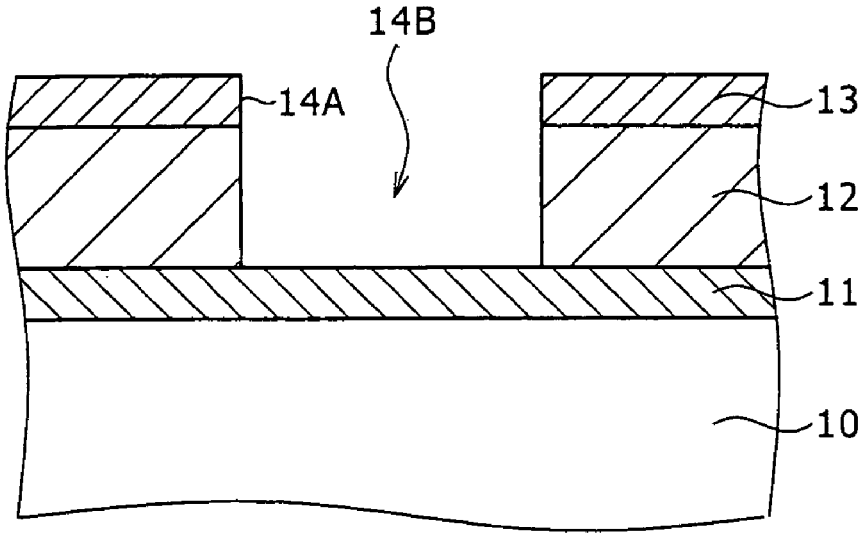
FIG. 11A through FIG. 11B are schematic fragmentary end views of a support and the like for describing a fabrication process of a Spindt-type cold cathode field electron emission device in Example 1.
Figure 11B:
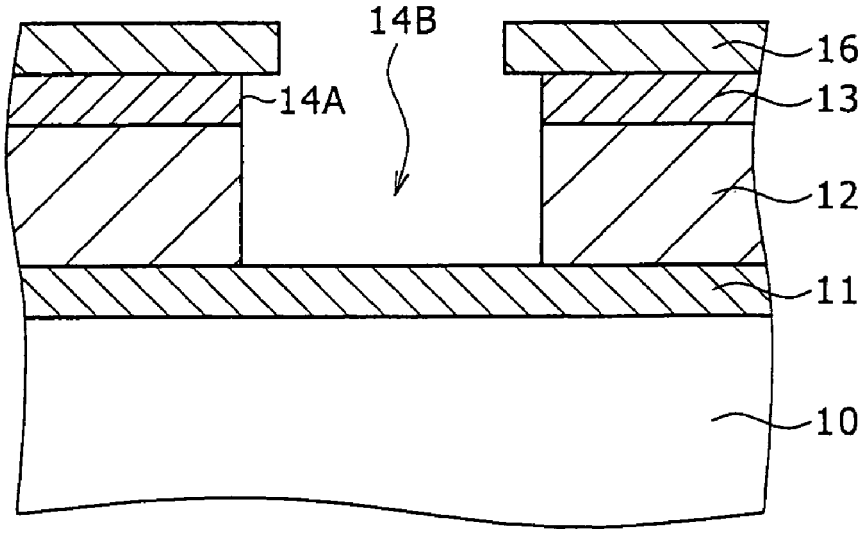

While rotating the support 10, nickel (Ni) is obliquely deposited over the insulating layer 12 including the gate electrodes 13 so that a strippable layer 16 is formed (see FIG. 11B). By selecting a substantially large incidence angle for evaporated particles, with respect to a line which is normal to the support 10 (for example, at an incidence angle of from 65 degrees to 85 degrees), the strippable layer 16 can be formed over the gate electrodes 13 and the insulating layer 12, without any substantial deposition of nickel in the bottom parts of the holes 14B. The strippable layer 16 extends inwards like a canopy from the edge of the opening 14A so that each opening 14A is practically reduced in diameter.

[Step-A4]

Figure 12A:
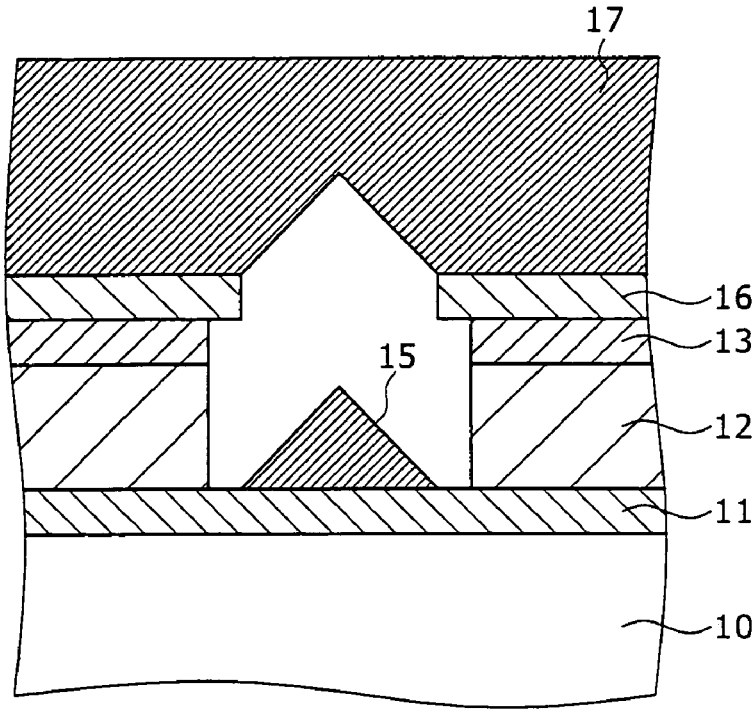
FIG. 12A through FIG. 12B are schematic fragmentary end views of a support and the like for describing, in continuation with FIG. 11B, the fabrication process of the Spindt-type cold cathode field electron emission device in Example 1.

The entire surface is then subjected to surface normal deposition, for example, with molybdenum (Mo) as an electrically-conductive material (incidence angle: 3 degrees to 10 degrees). As a conductive material layer 17 having the shape of an overhang grows over the strippable layer 16 at this time as illustrated in FIG. 12A, the actual diameter of the opening 14A becomes gradually smaller. Evaporated particles which contribute to the deposition in the bottom part of the hole 14B are, therefore, gradually limited to those passing through the center of the opening 14A. As a result, a circular conical deposit is formed in the bottom part of the hole 14B, and this circular conical deposit serves as the electron-emitting portion 15.

[Step-A5]

Figure 12B:
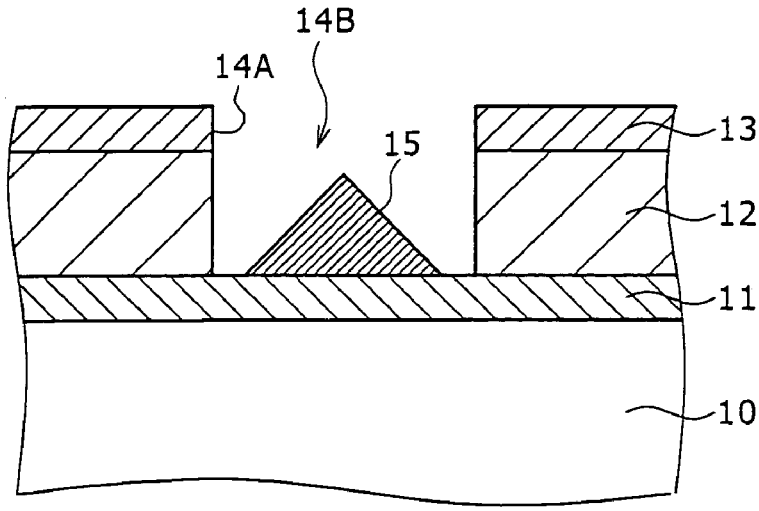

As shown in FIG. 12B, the strippable layer 16 is then stripped off from the surfaces of the gate electrodes 13 and insulating layer 12 by a lift-off process to selectively remove the conductive material layer 17 above the gate electrodes 13 and the insulating layer 12. In this manner, a cathode panel with plural Spindt-type field emission devices formed thereon can be obtained. Subsequently, the side walls of the holes 14B arranged in the insulating layer 12 are preferably caused to retreat from the viewpoint of having the opening edges of the gate electrodes 13 exposed. This isotropic etching can be conducted by dry etching, which makes use of radicals as a primary etching species as in chemical dry etching, or by wet etching, which makes use of an etching solution. As the etching solution, a 1:100 (volume ratio) mixed solution of a 49% aqueous solution of hydrofluoric acid and pure water can be used, for example. In this manner, the field emission device shown in FIG. 12B can be completed.

[Step-A6]

The assembly of a display is next conducted. Specifically, an anode panel AP with phosphor regions, an anode electrode and the like formed thereon is provided. Spacers 25 are then attached, for example, to spacer-holding portions (not shown) arranged in a valid region of the anode panel AP, the anode panel AP and the cathode panel CP are arranged such that the phosphor regions 22 and electron-emitting regions EA face each other, and the anode panel AP and the cathode panel CP (more specifically, the substrate 20 and the support 10) are joined together at their peripheral edge portions via a frame 26 made of ceramics or glass and having a height of about 2 mm. Upon conducting the joining, frit glass is coated to the frame 26 and the anode panel AP at positions where they are to be joined together and also to the frame 26 and the cathode panel CP at positions where they are to be joined together. The anode panel AP, cathode panel CP and frame 26 are bonded together, and, subsequent to drying the frit glass by pre-firing, main firing is conducted at about 450° C. for 10 to 30 minutes. A space surrounded by the anode panel AP, cathode panel CP, frame 26 and frit glass (not shown) is then evacuated through a through-hole (not shown) and a tip tube (not shown). When the pressure in the space has reached $10^{-4}$ Pa or so, the tip tube is sealed and cut off by fusion under heat. In this manner, the space surrounded by the anode panel AP, cathode panel CP and frame 26 can be brought into a vacuum. As an alternative, the bonding of the frame 26, anode panel AP and cathode panel CP can be conducted in a vacuum atmosphere. Depending on the structure of the display, the anode panel AP and the cathode panel CP may be bonded together only by an adhesive layer without any frame. Subsequently, necessary wiring and connection to external circuits is conducted to complete the display.

EXAMPLE 2

Example 2 relates to a fixed pixel display device, according to the present invention, and also to a cold cathode field electron emission display device, according to a second embodiment of the present invention.

Figure 4:
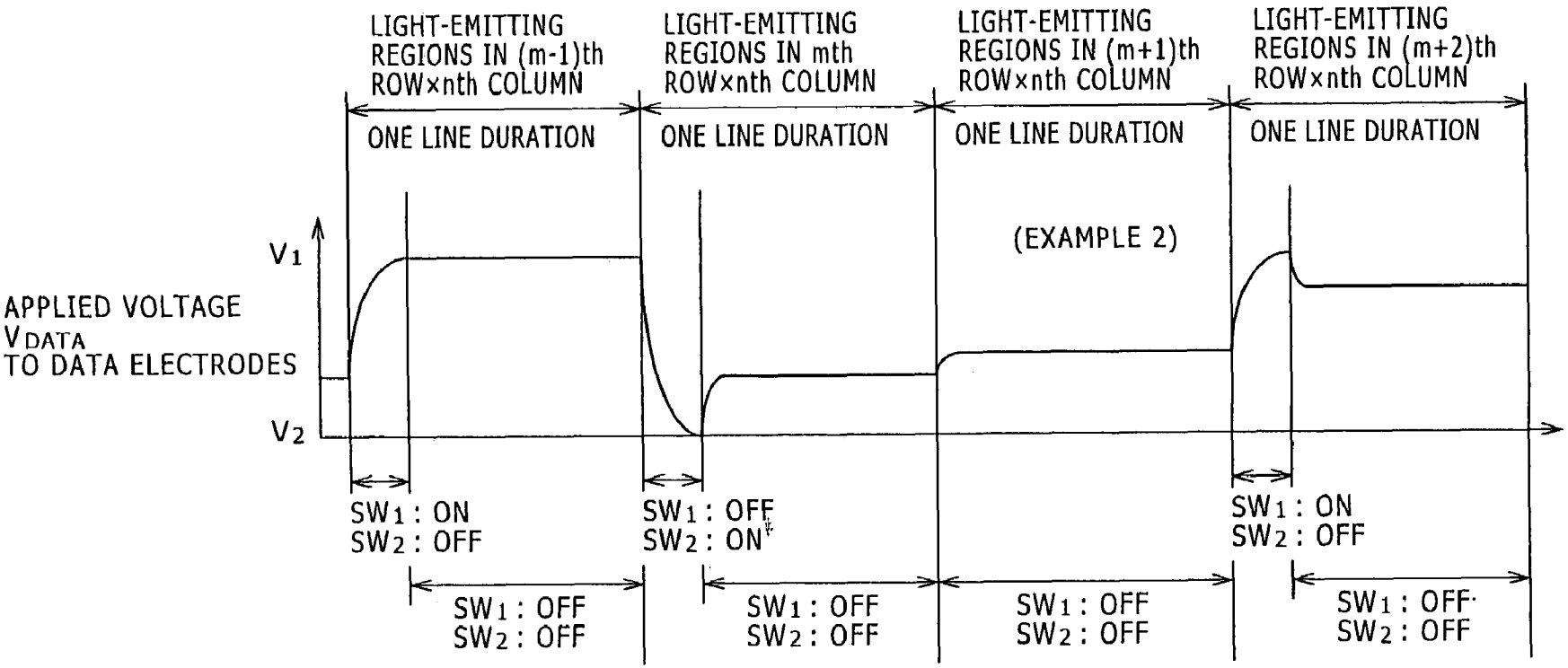
FIG. 4 is a diagram schematically illustrating the state of application of a voltage to an electrode (more specifically, a gate electrode) in a fixed pixel display device or cold cathode field electron emission display device of Example 2.

A circuit diagram of an actuation driver and the like in Example 2 and a conceptual diagram of the fixed pixel display device of Example 2 are similar to those shown in FIG. 1 and FIG. 2, respectively, and a schematic fragmentary end view of the cold cathode field electron emission display device of Example 2, an exploded, schematic fragmentary perspective view of a cathode panel CP and anode panel AP, and layouts of phosphor regions and the like are similar to those depicted in FIG. 5, FIG. 6, and FIG. 7 through FIG. 10. The state of application of a voltage to data electrodes (gate electrodes) in the display of Example 2 is schematically illustrated in FIG. 4.

The cold cathode field electron emission display device of Example 2 is constructed of the cathode panel CP and the anode panel AP joined together at their peripheral edge portions. A space sandwiched between the cathode panel CP and the anode panel AP is maintained in a vacuum state. It is to be noted that in Example 2, the cathode electrodes 11 correspond to the scanning electrodes and the gate electrodes 13 correspond to the data electrodes.

In Example 2, the cathode panel CP is formed of:

(a) a support 10, (b) a plurality number M (M≧2) of stripe-shaped cathode electrodes 11, formed on the support 10 and extending in the first direction (in a direction parallel to the sheet of FIG. 5), (c) an insulating layer 12 formed over the support 10 and cathode electrodes 11, (d) a plurality number N(N≧2) of stripe-shaped gate electrodes 13, formed on the insulating layer 12 and extending in the second direction different from the first direction (in a direction perpendicular to the sheet of FIG. 5), and (e) electron-emitting regions EA, located at overlap regions between the cathode electrodes 11 and the gate electrodes 13.

The anode panel AP, on the other hand, has a similar construction and structure as the anode panel AP described in Example 1.

Further, each electron-emitting region EA is composed of an electron-emitting portion 15, located in a bottom part of its corresponding hole 14 arranged in the associated gate electrode 13, and the insulating layer 12 (an opening 14A arranged through the corresponding gate electrode 13 and a hole 14B arranged through the insulating layer 12). It is to be noted that in Example 2, each electron-emitting portion 15 is also in a circular conical form. Described specifically, this field emission device is a Spindt-type field emission device in which, as in Example 1, the circular conical electron-emitting portion 15 is arranged on the associated cathode electrode 11 located in the bottom part of the corresponding hole 14. These cathode electrodes 11 correspond to the scanning electrodes, these gate electrodes 13 correspond to the data electrodes, and these electron-emitting regions EA correspond to parts of the light-emitting regions. It is also to be noted that the first direction and the second direction intersect at right angles with each other. In other words, a projection image of the scanning electrodes (cathode electrodes 11) and a projection image of the data electrodes (gate electrodes 13) intersect at right angles with each other. Scanning signals are inputted to the cathode electrodes 11, while video signals (chrominance signals) are inputted to the gate electrodes 13.

The cold cathode field electron emission display device of Example 2 is also equipped with the actuation drivers 50 connected to the respective gate electrodes 13 to actuate the gate electrodes 13. Similar to Example 1, each actuation driver 50 is formed of a switching circuit, an output circuit 51, and a subtraction circuit 52. A gate electrode control circuit 31 connected to the gate electrodes 13 is formed of the multiple number N of actuation drivers 50 and the multiple number N of D/A converters 43 of, for example, 8 bits. Further, a cathode electrode control circuit 30, to which the cathode electrodes 11 are connected, is composed of a known power supply for applying a fixed voltage $V_C$ to the cathode electrodes 11 and an output circuit for the scanning electrodes.

Each switching circuit is provided with:

(A) a first switching circuit 53 (which may be indicated by a sign "$SW_1$", as shown in FIG. 4) for applying the first voltage $V_1$ on the data electrodes (gate electrodes 13), (B) a second switching circuit 54 (which may be indicated by a sign "$SW_2$", as shown in FIG. 4) for applying the second voltage $V_2$ ($V_2 \neq V_1$, more specifically $V_2 < V_1$ in Example 2) on the data electrodes (gate electrodes 13), and (C) a comparator 55 (comparators 55A, 55B) for performing on/off control of the first switching circuit 53 and second switching circuit 54.

In the display of Example 2, a voltage, outputted from the output circuit 51 on the basis of the value $D_{m,n}$ (m: any one of 2, 3, . . . , M; n: 1, 2 . . . , N) of data (gradation control data) for controlling a state of light emission at each of the multiple number N of light-emitting regions formed by the scanning electrodes in the $m^{th}$ row upon displaying an image, is applied to the data electrodes in the $n^{th}$ column during the fixed duration. In other words, a voltage (20 volts to 35 volts), outputted from the output circuit 51 on the basis of the value $D_{m,n}$ (m: any one of 2, 3, . . . , M; n: 1, 2, . . . , N) of data (gradation control data) for controlling a state of electron emission at each of the multiple number N of electron-emitting regions EA formed by the $m^{th}$ cathode electrodes 11, is applied to the $n^{th}$ gate electrodes 13 during the fixed duration.

Described specifically, as illustrated in FIG. 1, video signals are inputted to the A/D converter 41 of, for example, 8 bits, and data $D_{m,n}$ as outputs from the A/D converter 41 are stored once in the line buffer 42 equipped with line buffers in two systems. The data $D_{m,n}$, stored in the line buffer 42 and corresponding to gradation control data, are sequentially fed to the D/A converter 43, which constitutes the $n^{th}$ actuation driver 50, and analog signals from the D/A converter 43 are inputted to the output circuit 51, which makes up the actuation driver 50 connected to the data electrodes in the $n^{th}$ column ($n^{th}$ gate electrodes 13). In accordance with switching timing pulses (load signals), the scanning electrodes (cathode electrodes 11) in the $1^{st}$ row to the Mth row are line-sequentially actuated by the output circuit for the scanning electrodes so that, for example, the fixed voltage $V_G$(=0 volt) is sequentially applied to the scanning electrodes (cathode electrodes 11). On the data electrodes (gate electrodes 13) in the $n^{th}$ (n: 1, 2, . . . , N) column, on the other hand, a voltage $V_{DATA}$ which varies by a voltage modulation method in accordance with the gradation is applied from the output circuit 51.

The output circuit 51 is a current buffer circuit composed of a CMOS circuit having a similar structure and construction as described in Example 1. By outputs from the respective output circuits 51, the individual data electrodes (individual gate electrodes 13) are actuated. The outputs from the output circuits 51 are practically the same as the voltage $V_{DATA}$ to be applied the conventional data electrode as illustrated in FIG. 3B.

In the display of Example 2, a value ($D_{m,n}-D_{m-1,n}$, that is, gradation-controlling difference data), obtained by subtracting at the subtraction circuit 52 the value $D_{m-1,n}$ of data (gradation control data) for controlling the state of light emission at each of the light-emitting regions composed by the scanning electrodes in the $(m-1)^{th}$ row from the value $D_{m,n}$ of data (gradation control data) for controlling the state of light emission at each of the light-emitting regions composed by the scanning electrodes in the $m^{th}$ row, is inputted as an input value to the comparator 55 (more specifically, the first comparator 55A and the second comparator 55B). In other words, a value ($D_{m,n}-D_{m-1,n}$, that is, gradation-controlling difference data), obtained by subtracting at the subtraction circuit 52 the value $D_{m-1,n}$ of data (gradation control data) for controlling the state of electron emission at each of the electron-emitting regions EA composed by the $(m-1)^{th}$ cathode electrodes 11 from the value $D_{m,n}$ of data (gradation control data) for controlling the state of electron emission at each of the electron-emitting regions EA composed by the $m^{th}$ cathode electrodes 11, is inputted as an input value to the comparator 55 (more specifically, the first comparator 55A and the second comparator 55B). On the other hand, the first reference value is inputted to the first comparator 55A, and the second reference value is inputted to the second comparator 55B.

Described specifically, in Example 2, the fixed voltage $V_c$(=0 volt) is applied to the scanning electrodes (cathode electrodes 11) while the voltage $V_G$(=20 volts to 35 volts) is applied to the data electrodes (gate electrodes 13), in accordance with the gradation. To control the states of light emission at the light-emitting regions in the $(m-1)^{th}$ row×the $n^{th}$ column, the voltage $V_{DATA(m-1,n)}$ (the value of data at this time is $D_{m-1,n}$) is applied to the data electrodes, and to control the states of light emission at the light-emitting regions in the $m^{th}$ row×the $n^{th}$ column, the voltage $V_{DATA(m,n)}$ (the value of data at this time is $D_{m,n}$) is applied to the data electrodes. In other words, the voltage $V_{DATA(m-1,n)}$ (the value of data at this time is $D_{m-1,n}$) is applied to the gate electrodes 13 to control the states of electron emission at the $(m-1)^{th} \times n^{th}$ electron-emitting regions, and the voltage $V_{DATA(m,n)}$ (the value of data at this time is $D_{m,n}$) is applied to the gate electrodes 13 to control the states of electron emission at the $m^{th} \times n^{th}$ electron-emitting regions. The values $D_{m-1,n}$, $D_{m,n}$ of the data stored in the line buffer 42 are read and fed to the subtraction circuit 52, a value ($D_{m,n}-D_{m-1,n}$), obtained by performing a subtraction at the subtraction circuit 52, is inputted as an input value to the comparator 55 (the first comparator 55A and the second comparator 55B), and the input value ($D_{m,n}-D_{m-1,n}$), inputted to the comparator 55 (the first comparator 55A and the second comparator 55B), and the first reference value and second reference value are compared at the comparator 55.

Now assuming that the difference between the voltage applied to the scanning electrodes and the voltage applied to the data electrodes is $\Delta V$, the first voltage $V_1$ is a voltage to be applied to the data electrodes to obtain a maximum value of $\Delta V$, while the second voltage $V_2$ is a voltage to be applied to the data electrodes to obtain a minimum value of $\Delta V$. In Example 2, as the voltage to be applied to the scanning electrodes is less than the voltage to be applied to the data electrodes, $V_1 > V_2$. In other words, when the difference between the voltage (for example, 20 volts to 35 volts depending on the gradation) to be applied to the gate electrodes 13 and the voltage (for example, fixed at 0 volt) to be applied to the cathode electrodes 11 is assumed to be AVGC, the first voltage $V_1$ is a voltage (namely, 35 volts) to be applied to the gate electrodes 13 to obtain a maximum value (namely, 35 volts) of $\Delta V_{GC}$, while the second voltage $V_2$ is a voltage (namely, 20 volts) to be applied to the gate electrodes 13 to obtain a minimum value (namely, 20 volts) of $\Delta V_{GC}$. Assuming that the first reference value is a value corresponding to a voltage $\alpha(V_1-V_2)$ and the second reference value is a value corresponding to a voltage $\beta(V_2-V_1)$, the value of $\alpha$ and the value of $\beta$ are set at 0.5 and 0.5, respectively. Now, assuming that the value $D_{m,n}$, of data as input digital data to the subtraction circuit 52, has 8 bits, 256-level gradation control is performed. Here, $D_{m,n}$=255 is supposed to represent the brightest screen data. If the value of $\alpha$ and the value of $\beta$ are supposed to become $\alpha'$ and $\beta'$ when converted into 8-bit digital expressions, $\alpha'$=128 and $\beta'$=128. In general, it is preferred to satisfy $32 \leqq \alpha' \leqq 192$ and $32 \leqq \beta' \leqq 192$.

When the input value is not smaller than the first reference value, in other words, when $(D_{m,n}-D_{m-1,n}) > \alpha'$ or $(D_{m,n}-D_{m-1,n}) \geqq \alpha'$, the first switching circuit 53 is maintained in an ON state during a predetermined duration (for example, 5 microseconds) shorter than the fixed duration (for example, 25 microseconds) on the basis of an output from the first comparator 55A so that during the predetermined duration (for example, 5 microseconds), the first voltage $V_1$(=35 volts)

is applied to the data electrodes in the $n^{th}$ column (the $n^{th}$ gate electrodes 13). In FIG. 4, this state is shown as the applied voltage $V_{DATA}$ on the data electrodes in the $(m-1)^{th}$ row×the $n^{th}$ column during a one-line duration and on the data electrodes in the $(m+2)^{th}$ row×the $n^{th}$ column during a one-line duration.

When the input value is not greater than the second reference value, on the other hand, in other words, when $(D_{m,n}-D_{m-1,n})<\beta'$ or $(D_{m,n}-D_{m-1,n})\geqq\beta'$, the second switching circuit 54 is maintained in an ON state during a predetermined duration (for example, 5 microseconds) shorter than the fixed duration (for example, 25 microseconds) on the basis of an output from the second comparator 55B so that during the predetermined duration (for example, 5 microseconds), the second voltage $V_2$ (=20 volts) is applied to the data electrodes in the $n^{th}$ column (the $n^{th}$ gate electrodes 13). In FIG. 4, this state is shown as the applied voltage $V_{DATA}$ on the data electrodes in the $m^{th}$ row×the $n^{th}$ column during a one-line duration.

When the input value is smaller than the first reference value, but is greater than the second reference value, in other words, when $\beta'\leqq(D_{m,n}-D_{m-1,n})\leqq\alpha'$ or $\beta'<(D_{m,n}-D_{m-1,n})<\alpha'$, the first switching circuit 53 and second switching circuit 54 are maintained in OFF states, respectively. In FIG. 4, this state is shown as a one-line duration in the $(m+1)^{th}$ row×the $n^{th}$ column.

As has been described above, in Example 2, the leading-edge and trailing-edge waveforms of the voltage $V_{DATA}$ to be impressed on the data electrodes (gate electrodes 13) immediately after the state of an application to the scanning electrodes is changed over, for example, from the $m^{th}$ row to the $(m+1)^{th}$ row (in other words, immediately after the state of an application to the cathode electrodes 11 is changed over, for example, from the $m^{th}$ cathode electrodes to the $(m+1)^{th}$ cathode electrodes) can be made steep by additionally applying the voltages $V_1$,$V_2$. As a result, it is possible to improve the response for the display of an image and hence, to achieve a smooth display of the image. Moreover, an increase in power to be consumed in the fixed pixel display device or cold cathode field electron emission display device can be reduced because the duration (time) during which the first voltage $V_1$ or the second voltage $V_2$ is applied to the data electrodes in the $n^{th}$ column (or the $n^{th}$ gate electrodes 13) is shorter than the fixed duration. In addition, an image with its contour emphasized can be obtained so that an increased degree of sharpness is available on an image to be visualized.

In Example 2, a voltage, outputted from the output circuit 51 on the basis of a value $D_{1,n}$ (n: 1, 2, . . . , N) of data for controlling a state of light emission at each of the multiple number N of light-emitting regions formed by the scanning electrodes in the $1^{st}$ row, is applied to the data electrodes in the $n^{th}$ column during the fixed duration. In other words, a voltage, outputted from the output circuit 51 on the basis of the value $D_{1,n}$ (n: 1, 2, . . . , N) of data for controlling a state of electron emission at each of the multiple number N of electron-emitting regions EA formed by the $1^{st}$ cathode electrodes 11, is applied to the $n^{th}$ gate electrode 13 during the fixed duration. At this time, a value $(D_{1,n}-D_{0,n})$, obtained by subtracting at the subtraction circuit the value "0" of data (expressed as "the data value $D_{0,n}$") from the value $D_{1,n}$ of data for controlling the state of light emission at each of the light-emitting regions composed by the scanning electrodes in the $1^{st}$ row, is inputted as an input value to the comparator, and the input value, inputted in the comparator, is compared with the first reference value and second reference value at the comparator. Instead of using the data value $D_{0,n}$, the value $D_{M,n}$ of the immediately preceding data (the value of the last data in a frame preceding by one frame) can be also used. As an alternative, a value $(D_{1,n}-D_{0,n})$, obtained by subtracting at the subtraction circuit the value "0" of data (expressed as "the data value $D_{0,n}$") from the value $D_{1,n}$ of data for controlling the state of light emission at each of the multiple number N of electron-emitting regions composed by the first cathode electrodes, is inputted as an input value to the comparator, and the input value, inputted in the comparator, is compared with the first reference value and second reference value at the comparator. Instead of using the data value $D_{0,n}$, the value $D_{M,n}$ of the immediately preceding data (the value of the last data in a frame preceding by one frame) can be also used.

The present invention has been described based on the preferred examples. The present invention, however, shall not be limited to these examples. The constructions and structures of the anode panels and cathode panels, various control circuits such as gate electrode control circuits and cathode electrode control circuits, displays, and field emission devices, said constructions and structures having been described in the Examples, are illustrative, and can be modified as needed. The fabrication processes of the anode panels, cathode panels, displays and field emission devices, said fabrication processes having been described in the Examples, are also illustrative, and can be modified as needed. Further, the various materials used in the fabrication of the anode panels and cathode panels are also illustrative and can be modified as needed. The displays were described primarily taking multicolor displaying as examples, but can be modified into monochromatic displays.

In each Example, the first reference value was set at only one value, and the second reference value was also set at only one value. It is, however, possible to set plural first reference values and plural second reference values. In such a case, the length of the predetermined duration may be changed corresponding to the plural first reference values or the plural second reference values. A plurality of comparators may be arranged to set plural values as the first voltage $V_1$ and also, plural values as the second voltage $V_2$. In each Example, a video signal was fed trough the A/D converter and D/A converter, and digital data, outputted from the A/D converter, is compared at the comparator with the first reference value and second reference value which are digital data. The present invention is, however, not limited to such a construction. It is possible to adopt such a construction that analog data, based on a video signal, is compared at the comparator with the first reference value and second reference value both of which are analog data.

With respect to the field emission devices, the description was made primarily about the form that one electron-emitting portion corresponds to one hole. Depending on the construction of the field emission device, it is possible to fabricate each field emission device in such a form that plural electron-emitting portions correspond to one hole or such a form that one electron-emitting portion corresponds to plural holes. It is also possible to fabricate each field emission device in such a form that plural openings are arranged in a gate electrode, plural holes communicated with the plural openings are arranged in an insulating layer, and one or plural electron-emitting portions are arranged.

The anode electrode can be provided as an anode electrode of the type that the valid region is covered with a single sheet-shaped conductive material as described in the Examples or as an anode electrode of the type that anode electrode units corresponding to one or plural electron-emitting portions or one or plural pixels are assembled together. When the anode electrode is of the former construction, it is only necessary to connect the anode electrode to the anode electrode control circuit. When the anode electrode is of the latter construction, it is only necessary, for example, to connect the respective anode electrode units to the anode electrode control circuit.

Figure 13:
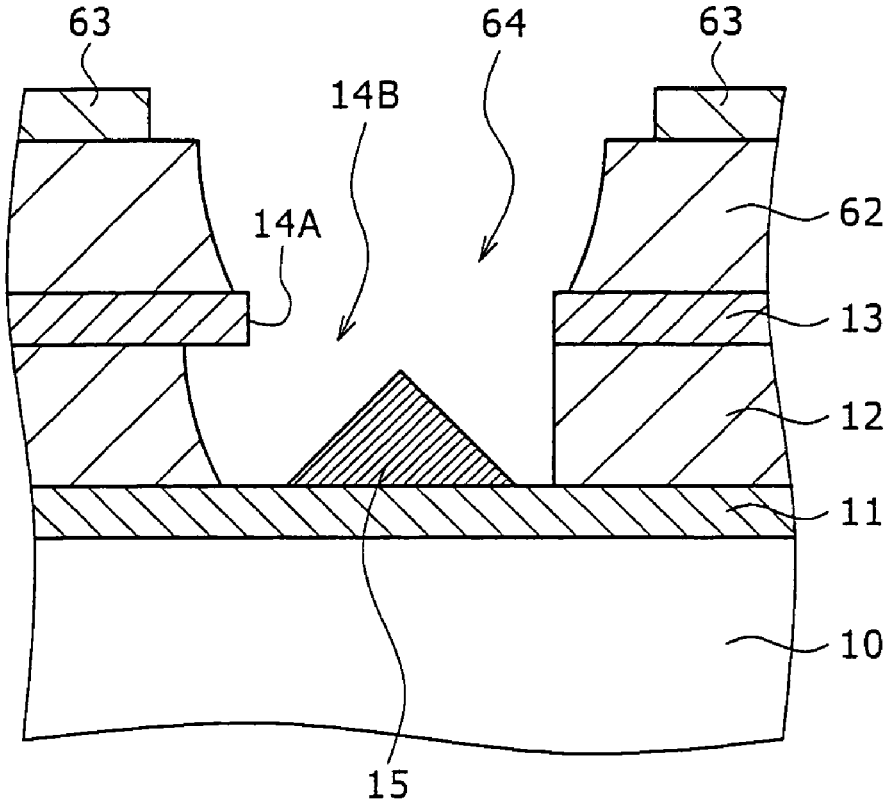
FIG. 13 is a schematic fragmentary end view of a cold cathode field electron emission device having a focusing electrode.
Figure 14:
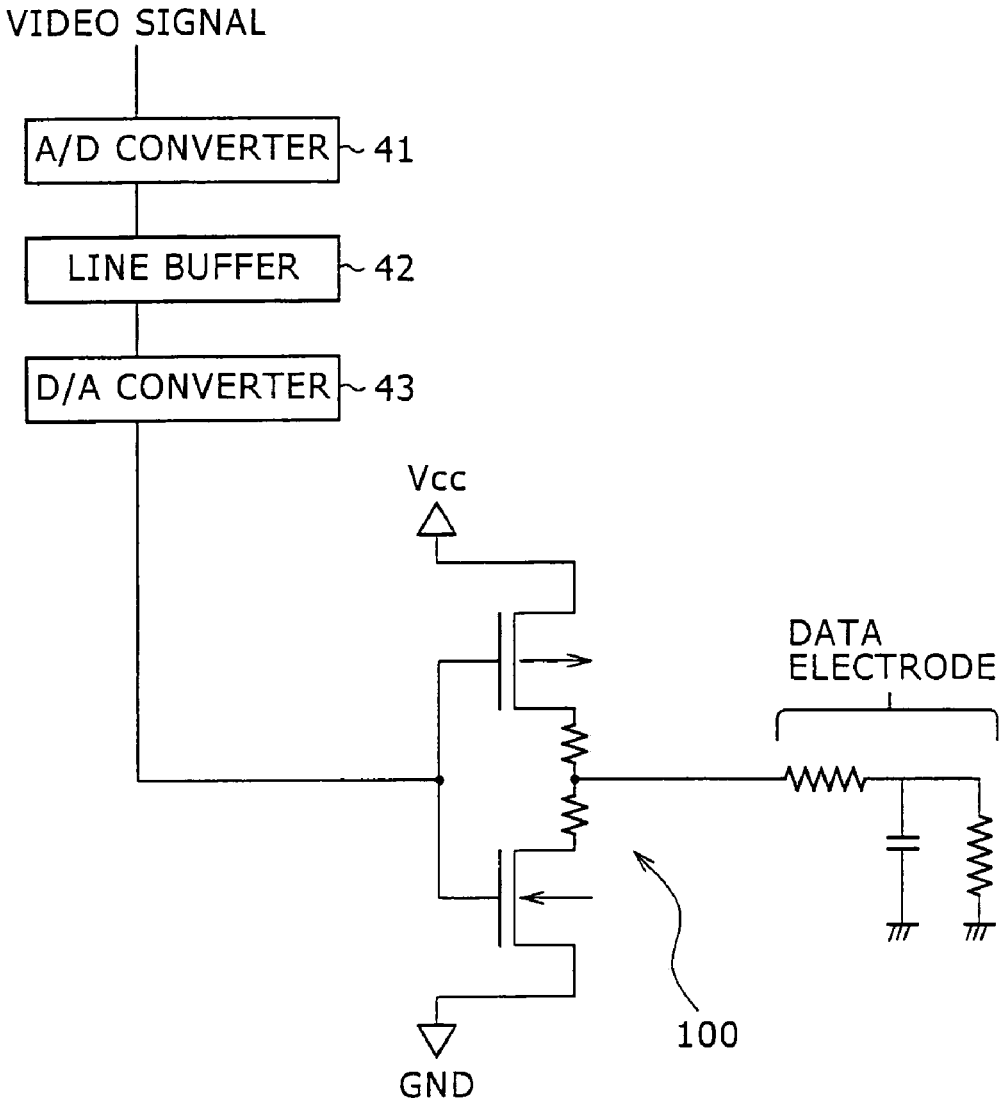
FIG. 14 is a circuit diagram of an output circuit for a data electrode in a conventional fixed pixel display device.

In each field emission device, it is also possible to additionally arrange an interlayer insulating layer 62 over the gate electrode 13 and insulating layer 12 and to arranged a focusing electrode 63 on the interlayer insulating layer 62. A schematic fragmentary end view of a field emission device having such a structure is shown in FIG. 13. Through the interlayer insulating layer 62, a hole 64 communicated with each opening 14A is arranged. The formation of the focusing electrode 63 can be effected, for example, by following [Step-A1]. After stripe-shaped gate electrodes 13 are formed on an insulating layer 12, an interlayer insulating layer 62 is formed. A patterned, focusing electrode 63 is then formed on the interlayer insulating layer 62, holes 64 are arranged through the focusing electrode 63 and interlayer insulating layer 62, and then, openings 14A are arranged through the gate electrodes 13. Relying upon the patterning of the focusing electrode, the focusing electrode can be formed into such a type that focusing electrode units, corresponding to one or plural electron-emitting portions or one or plural pixels, are assembled together, or into such a type that the valid region is covered by a single sheet of electrically-conductive material. In FIG. 13, a Spindt-type field emission element is illustrated. Needless to say, other focusing emission devices are also feasible. Further, field emission devices equipped with focusing electrodes can be applied to the displays described in Example 1 and Example 2.

The invention claimed is:

1. A fixed pixel display device provided with a multiple number M (M≧2) of stripe-shaped scanning electrodes extending in a first direction and another multiple number N(N≧2) of stripe-shaped data electrodes extending in a second direction different from said first direction such that light-emitting regions formed of overlap regions of said scanning electrodes and said data electrodes are arrayed in a two-dimensional matrix form of M rows×N columns, wherein:

said fixed pixel display device is provided with actuation drivers connected to the respective data electrodes to actuate said data electrodes;

each said actuation driver comprises a switching circuit, an output circuit, and a subtraction circuit;

said switching circuit is provided with:

(A) a first switching circuit for applying a first voltage $V_1$ to the corresponding data electrode, (B) a second switching circuit for applying a second voltage $V_2$ ($V_2 \neq V_1$) to the corresponding data electrodes, and (C) a comparator for performing on/off control of said first switching circuit and second switching circuit;

a voltage, outputted from said output circuit on a basis of a value $D_{m,n}$ (m: any one of 2, 3, . . . , M; n: 1, 2, . . . , N) of data for controlling states of light emission at a multiple number N of light-emitting regions formed of the scanning electrode in an $m^{th}$ row, is applied for a fixed duration to the data electrode in an $n^{th}$ column; and a value ($D_{m,n}-D_{m-1,n}$), obtained by subtracting at said subtraction circuit a value ($D_{m-1,n}$) of data for controlling states of light emission at respective light-emitting regions formed of the scanning electrode in an $(m^{-1})^{th}$ row from a value ($D_{m,n}$) of data for controlling states of light emission at respective light-emitting regions formed of said scanning electrode in said $m^{th}$ row, is inputted as an input value in said comparator, and said input value, inputted in said comparator, is compared with a first reference value and a second reference value at said comparator;

(1) when said input value is not smaller than said first reference value, said first switching circuit is maintained in an ON state for a predetermined duration shorter than said fixed duration on a basis of an output from said comparator such that during said predetermined duration, a first voltage $V_1$ is applied to the data electrode in said $n^{th}$ column;

(2) when said input value is not greater than said second reference value, said second switching circuit is maintained in an ON state for a predetermined duration shorter than said fixed duration on a basis of said output from said comparator such that during said predetermined duration, a second voltage $V_2$ is applied to the data electrode in said $n^{th}$ column; and (3) when said input value is smaller than said first reference value but is greater than said second reference value, said first switching circuit and said second switching circuit are maintained in OFF-states, respectively.

2. The fixed pixel display device according to claim 1, wherein, when a difference between a voltage to be applied to said scanning electrode and a voltage to be applied to said data electrode is assumed to be ΔV, said first voltage $V_1$ is a voltage to be applied to said data electrode to obtain a maximum value of ΔV, and said second voltage $V_2$ is a voltage to be applied to said data electrode to obtain a minimum value of ΔV.

3. The fixed pixel display device according to claim 1, wherein said output circuit is a current buffer circuit comprising a CMOS circuit.

4. A cold cathode field electron emission display device comprising a cathode panel and an anode panel joined together at peripheral edge portions thereof, wherein:

said cathode panel is composed of:

(a) a support, (b) a multiple number N(N≧2) of stripe-shaped cathode electrodes formed on said support and extending in a first direction, (c) an insulating layer formed over said support and cathode electrodes, (d) another multiple number M (M≧2) of stripe-shaped gate electrodes formed on said insulating layer and extending in a second direction different from said first direction, and (e) electron-emitting regions located at overlap regions of said cathode electrodes and said gate electrodes;

said anode panel is composed of a substrate and phosphor regions and an anode electrode formed on said substrate and arranged corresponding to the electron-emitting regions;

said electron-emitting regions are composed of electron-emitting portions located in bottom parts of holes arranged in said gate electrodes and insulating layer;

said cold cathode field electron emission display device is further provided with:

(f) actuation drivers connected to the respective cathode electrodes to actuate said cathode electrodes;

said actuation drivers each comprises a switching circuit, an output circuit, and a subtraction circuit;

said switching circuit is provided with:

(A) a first switching circuit for applying a first voltage $V_1$ to the corresponding cathode electrode, (B) a second switching circuit for applying a second voltage $V_2$ ($V_2 \geqq V_1$) to the corresponding cathode electrode, and (C) a comparator for performing on/off control of said first switching circuit and second switching circuit;

a voltage, outputted from said output circuit on a basis of a value $D_{m,n}$ (m: any one of 2, 3, . . . , M; n: 1, 2, . . . , N) of data for controlling states of electron emission at a multiple number N of electron-emitting regions formed of an $m^{th}$ gate electrode, is applied for a fixed duration to an $n^{th}$ cathode electrode; and a value $(D_{m,n}-D_{m-1,n})$, obtained by subtracting at said subtraction circuit a value $D_{m-1,n}$ of data for controlling states of electron emission at the respective electron-emitting regions formed of an $(m-1)^{th}$ gate electrode from a value $D_{m,n}$ of data for controlling states of electron emission at the respective electron-emitting regions composed by said $m^{th}$ gate electrode, is inputted as an input value in said comparator, and said input value, inputted in said comparator, is compared with a first reference value and a second reference value at said comparator;

(1) when said input value is not smaller than said first reference value, said first switching circuit is maintained in an ON state for a predetermined duration shorter than said fixed duration on a basis of an output from said comparator such that during said predetermined duration, a first voltage $V_1$ is applied to said $n^{th}$ cathode electrode;

(2) when said input value is not greater than said second reference value, said second switching circuit is maintained in an ON state for a predetermined duration shorter than said fixed duration on a basis of said output from said comparator such that during said predetermined duration, a second voltage $V_2$ is applied to the $n^{th}$ cathode electrode; and (3) when said input value is smaller than said first reference value but is greater than said second reference value, said first switching circuit and said second switching circuit are maintained in OFF-states, respectively.

5. The cold cathode field electron emission display device according to claim 4, wherein, when a difference between a voltage to be applied to said gate electrode and a voltage to be applied to said cathode electrode is assumed to be AVGC, said first voltage $V_1$ is a voltage to be applied to said cathode electrode to obtain a maximum value of $\Delta V_{GC}$, and said second voltage $V_2$ is a voltage to be applied to said cathode electrode to obtain a minimum value of $\Delta V_{GC}$.

6. The cold cathode field electron emission display device according to claim 4, wherein said output circuit is a current buffer circuit comprising a CMOS circuit.

7. A cold cathode field electron emission display device comprising a cathode panel and an anode panel joined together at peripheral edge portions thereof, wherein:

said cathode panel is composed of:

(a) a support, (b) a multiple number M ($M \geqq 2$) of stripe-shaped cathode electrodes formed on said support and extending in a first direction, (c) an insulating layer formed over said support and cathode electrodes, (d) another multiple number N($N \geqq 2$) of stripe-shaped gate electrodes formed on said insulating layer and extending in a second direction different from said first direction, and (e) electron-emitting regions located at overlap regions of said cathode electrodes and said gate electrodes;

said anode panel is composed of a substrate and phosphor regions and an anode electrode formed on said substrate and arranged corresponding to the electron-emitting regions;

said electron-emitting regions are composed of electron-emitting portions located in bottom parts of holes arranged in said gate electrodes and insulating layer;

said cold cathode field electron emission display device is further provided with:

(f) actuation drivers connected to the respective gate electrodes to actuate said gate electrodes;

said actuation drivers each comprises a switching circuit, an output circuit, and a subtraction circuit;

said switching circuit is provided with:

(A) a first switching circuit for applying a first voltage $V_1$ to the corresponding gate electrode, (B) a second switching circuit for applying a second voltage $V_2$ ($V_2<V_1$) on the corresponding gate electrode, and (C) a comparator for performing on/off control of said first switching circuit and second switching circuit;

a voltage, outputted from said output circuit on a basis of a value $D_{m,n}$ (m: any one of 2, 3, . . . , M; n: 1, 2, . . . , N) of data for controlling states of electron emission at a multiple number N of electron-emitting regions formed of an $m^{th}$ cathode electrode, is applied for a fixed duration to an $n^{th}$ gate electrode; and a value $(D_{m,n}-D_{m-1,n})$, obtained by subtracting at said subtraction circuit a value $D_{m-1,n}$ of data for controlling states of electron emission at the respective light-emitting regions formed of an $(m-1)^{th}$ cathode electrode from a value $D_{m,n}$ of data for controlling states of electron emission at the respective electron-emitting regions composed by said $m^{th}$ cathode electrode, is inputted as an input value in said comparator, and said input value, inputted in said comparator, is compared with a first reference value and a second reference value at said comparator;

(1) when said input value is not smaller than said first reference value, said first switching circuit is maintained in an ON state for a predetermined duration shorter than said fixed duration on a basis of an output from said comparator such that during said predetermined duration, a first voltage $V_1$ is applied to said $n^{th}$ gate electrode;

(2) when said input value is not greater than said second reference value, said second switching circuit is maintained in an ON state for a predetermined duration shorter than said fixed duration on a basis of said output from said comparator such that during said predetermined duration, a second voltage $V_2$ is applied to the $n^{th}$ gate electrode; and (3) when said input value is smaller than said first reference value but is greater than said second reference value, said first switching circuit and said second switching circuit are maintained in OFF-states, respectively.

8. The cold cathode field electron emission display device according to claim 7, wherein, when a difference between a voltage to be applied to said gate electrode and a voltage to be applied to said cathode electrode is assumed to be $\Delta V_{GC}$, said first voltage $V_1$ is a voltage to be applied to said gate electrode to obtain a maximum value of $\Delta V_{GC}$, and said second voltage $V_2$ is a voltage to be applied to said gate electrode to obtain a minimum value of $\Delta V_{GC}$.

9. The cold cathode field electron emission display device according to claim 7, wherein said output circuit is a current buffer circuit comprising a CMOS circuit.

* * * * *

UNITED STATES PATENT AND TRADEMARK OFFICE

CERTIFICATE OF CORRECTION

PATENT NO. : 7,405,711 B2
APPLICATION NO. : 10/567923
DATED : July 29, 2008
INVENTOR(S) : Hiroyuki Ikeda It is certified that error appears in the above-identified patent and that said Letters Patent is hereby corrected as shown below:

Column 35, Line 36:
"AVGC" should read -- $\Delta V_{GC}$ --.

Signed and Sealed this

Thirtieth Day of September, 2008

JON W. DUDAS
*Director of the United States Patent and Trademark Office*